US009453510B2

(12) United States Patent
Kawanishi et al.

(10) Patent No.: US 9,453,510 B2
(45) Date of Patent: Sep. 27, 2016

(54) VACUUM PUMP

(75) Inventors: Shinji Kawanishi, Funabashi (JP); Takashi Sudo, Funabashi (JP)

(73) Assignee: Edwards Japan Limited, Chiba (JP)

( * ) Notice: Subject to any disclaimer, the term of this patent is extended or adjusted under 35 U.S.C. 154(b) by 542 days.

(21) Appl. No.: 13/991,069

(22) PCT Filed: Oct. 18, 2011

(86) PCT No.: PCT/JP2011/073911
§ 371 (c)(1),
(2), (4) Date: May 31, 2013

(87) PCT Pub. No.: WO2012/077411
PCT Pub. Date: Jun. 14, 2012

(65) Prior Publication Data

US 2013/0243583 A1 Sep. 19, 2013

(30) Foreign Application Priority Data

Dec. 10, 2010 (JP) ..... 2010-275528

(51) Int. Cl.

| | |
|---|---|
| ***F04D 19/04*** | (2006.01) |
| ***F04D 3/00*** | (2006.01) |
| ***F04D 29/52*** | (2006.01) |
| ***F04D 29/64*** | (2006.01) |

(Continued)

(52) U.S. Cl.
CPC ..... *F04D 3/00* (2013.01); *F04D 19/042* (2013.01); *F04D 19/044* (2013.01); *F04D 19/046* (2013.01); *F04D 29/526* (2013.01); *F04D 29/541* (2013.01); *F04D 29/642* (2013.01); *F04D 29/701* (2013.01)

(58) Field of Classification Search
CPC .. F04D 19/042; F04D 19/044; F04D 29/526; F04D 29/541; F04D 29/642
See application file for complete search history.

(56) References Cited

U.S. PATENT DOCUMENTS 5,116,196 A * 5/1992 Baret ..... F04D 19/044 415/89
6,599,084 B1 * 7/2003 Schutz ..... F04D 19/04 415/104

(Continued)

FOREIGN PATENT DOCUMENTS

JP 52-86576 A 7/1977
JP 2002-180988 A 6/2002

(Continued)

OTHER PUBLICATIONS

International Search Report dated Jan. 24, 2012 for corresponding International Application No. PCT/JP2011/073911, filed Oct. 18, 2011.

(Continued)

*Primary Examiner* — Ninh H Nguyen
(74) *Attorney, Agent, or Firm* — Westman, Champlin & Koehler, P.A.

(57) ABSTRACT

In a rotor blade cylindrical portion or a stator portion in which thread grooves are formed, convex surfaces (thread groove peak surfaces) configuring the peak sections of the thread grooves are cut by a desired amount over the entire circumference (a circumferential direction of the thread grooves) of a certain range in an axial direction. As a result, the gap on the lower side of the thread groove portion can partially be expanded by cutting the thread groove peak surfaces by a desired amount.

16 Claims, 14 Drawing Sheets

(51) Int. Cl.
*F04D 29/70* (2006.01)
*F04D 29/54* (2006.01)

(56) References Cited

U.S. PATENT DOCUMENTS 6,793,466 B2 * 9/2004 Miyamoto ..... F04D 29/584 415/177
2003/0103842 A1 * 6/2003 Nonaka ..... F04D 19/046 415/90

FOREIGN PATENT DOCUMENTS

JP 2003-172289 A 6/2003
JP 2003-286992 A 10/2003
WO 2011/070856 A1 6/2011

OTHER PUBLICATIONS

Microfilm of the specification and drawings annexed to the request of Japanese Utility Model Application No. 185413/1987 (Laid-open No. 91096/1989), Osaka Vacuum Ltd., Jun. 15, 1989, Fig. 2.

Microfilm of the specification and drawings annexed to the request of Japanese Utility Model Application No. 36649/1993 (Laid-open No. 8590/1995), Seiko Instruments Inc., Feb. 7, 1995, paragraphs [0004] to [0005].

* cited by examiner

VACUUM PUMP

CROSS-REFERENCE TO RELATED APPLICATION

This Application is a Section 371 National Stage Application of International Application No. PCT/JP2011/073911, filed Oct. 18, 2011, which is incorporated by reference in its entirety and published as WO 2012/077411 on Jun. 14, 2012, not in English, and which claims priority to Japanese Patent Application 2010-275528 filed on Dec. 10, 2010.

BACKGROUND

The present invention relates to a vacuum pump. Specifically, the present invention relates to a vacuum pump which is a composite turbo molecular pump with a thread groove type pump portion in which a space (gap, clearance) between a stator portion and a rotary portion on the lower side of a thread groove portion can be changed.

Among all various vacuum pumps, turbo molecular pumps and thread groove type pumps are greatly used for realizing a high vacuum environment.

A chamber for semiconductor manufacturing equipment, a test chamber of an electron microscope, a surface analysis device, a microfabrication device, and the like are used as vacuum apparatuses, the insides of which are maintained vacuum through an exhaust process using a vacuum pump such as a turbo molecular pump or a thread groove type pump.

Such a vacuum pump for realizing a high vacuum environment has a casing that configures a casing having an inlet port and an outlet port. A structure that exerts an exhaust function of the vacuum pump is accommodated in this casing. The structure exerting an exhaust function is basically configured by a rotary portion (rotor portion) that is supported rotatably and a stator portion that is fixed to the casing.

In case of a turbo molecular pump, a rotary portion has a a rotating shaft and a rotary body fixed to the rotating shaft, wherein the rotary body has a plurality of stages of rotor blades (moving blades) arranged radially. The stator portion has a plurality of stages of stator blades (stationary blades) arranged alternately with respect to the rotor blades.

The turbo molecular pump is also provided with a motor for rotating the rotating shaft at high speed. When the rotary shaft is rotated at high speed by the operation of the motor, gas is drawn through the inlet port by the interaction between the rotor blades and the stator blades and discharged from the outlet port.

Incidentally, in such vacuum pumps as these turbo molecular pumps and thread groove type pumps, exhaust gas that includes microparticles of a reaction product generated in, for example, a chamber for semiconductor manufacturing equipment or other particles (e.g., particles of several μ to several hundred μm) generated in a vacuum container, is taken in through the inlet port.

Depending on the processes performed by the vacuum apparatus disposed in the vacuum pump, the suspended matters called particles inevitably adheres to the inside of the vacuum pump as products (deposits). Exhaust gas that is discharged in this manner, too, might be solidified into products in response to a sublimation curve (vapor pressure curve). Such products are often deposited and solidified especially in the vicinity of the outlet port where the pressure of the gas is high.

A gas passage becomes narrow and back pressure increases as the deposition of the products proceeds in the vicinity of the outlet port. As a result, the exhaust performance of the vacuum pump deteriorates significantly.

In addition, the rotary body of the vacuum pump is made of metal such as aluminum alloy and normally rotates at 20000 rpm to 90000 rpm. The peripheral velocity of the tips of the rotor blades reaches 200 m/s to 400 m/s. This consequently causes a phenomenon called "creep" where the rotor portion (especially the rotor blades) of the vacuum pump expands thermally or becomes distorted in a radial direction over the course of operating time. Because the thermal expansion or creep phenomenon of the vacuum pump occur more significantly on the lower side (outlet port side) of the rotary body than on the upper side (inlet port side) of the same, the expanded rotary body and the deposited products might come into contact with each other especially on the outlet port side.

Moreover, in a case where the apparatus disposed in the vacuum pump is a chamber for semiconductor manufacturing equipment, since the main raw material of a wafer used for manufacturing a semiconductor is silicon, the deposited products are harder than the rotary body made of aluminum alloy. When such products come into contact with the rotary body rotating at high speed as described above, the rotary body with lower hardness breaks, and, in the worst case, the functions of the vacuum pump stop.

Because such a vacuum pump has a problem in which a part of the vacuum pump comes into contact with products deposited in the vicinity of the outlet port where the pressure/temperature of the gas is high, which deteriorates the performance of the vacuum pump and breaks the rotor blades, an overhaul for disassembling the apparatus and carefully cleaning the same needs to be performed on a regular basis in order to remove the adhered products.

There has been conventionally proposed a technology for adjusting a space (clearance) between a rotor and a stationary wall from the outside of a casing, for the purpose of coping with the creep phenomenon described above.

Japanese Patent Application Publication No. 2003-286992 discloses a turbo molecular pump in which a casing thereof is provided with an axial flow stage portion configured by moving blades and stationary blades, and a thread groove stage portion configured by a thread groove rotor portion and a seal ring, wherein a minimum space is secured between the thread groove rotor portion and the seal ring. This turbo molecular pump is provided with space adjusting means for forming sections facing each other in a radial direction with the space therebetween into a tapered shape and adjusting the space by moving the seal ring from the outside of the casing in an axial direction.

According to this configuration in which the thread groove rotor portion and the seal ring are relatively moved in the axial direction, the rotor of the turbo molecular pump is prevented from being deformed and coming into contact with the stationary wall (seal ring), by adjusting/managing the size of the space between the thread groove rotor portion and the seal ring. In this manner, the operating life of the turbo molecular pump is extended.

In Japanese Patent Application Publication No. 2003-286992, however, the space between the thread groove rotor portion and the seal ring is adjusted based on the configuration in which the thread groove rotor portion and the seal ring are relatively moved over the entire surface of the thread groove rotor portion in the axial direction, resulting in expanding the space between the thread groove rotor portion and the seal ring, including the portions that do not require any adjustments (i.e., the upper side of the thread groove rotor portion; the section on the outlet port side).

However, as described above, the products are likely to be deposited in the section where the pressure of the gas is high (e.g., the lower side of the thread groove spacer of the thread groove type pump portion). Therefore, as disclosed in Japanese Patent Application Publication No. 2003-286992, if the thread groove rotor portion and the seal ring are relatively moved over the entire surface of the thread groove rotor portion in the axial direction with the purpose of expanding a space where the products deposit, the space is expanded at a constant interval in the axial direction, resulting in expanding a space in a section where the products rarely deposit (e.g., the upper side of the thread groove spacer of the thread groove type pump portion). This might deteriorate the performance of the vacuum pump more than necessary.

The discussion above is merely provided for general background information and is not intended to be used as an aid in determining the scope of the claimed subject matter. The claimed subject matter is not limited to implementations that solve any or all disadvantages noted in the background.

SUMMARY

Claim 1 provides a vacuum pump having: a casing in which an inlet port and an outlet port are formed; a stator portion disposed on an inner side surface of the casing; a rotating shaft enclosed in the casing and supported rotatably; a rotor portion fixed to the rotating shaft; a first gas transfer mechanism that has rotor blades disposed radially from an outer circumferential surface of the rotor portion, and stator blades protruding from an inner side surface of the stator portion toward the rotating shaft, and transfers, to the outlet port, gas suctioned from the inlet port by an interaction between the rotor blades and the stator blades; and a second gas transfer mechanism that is disposed on the outlet port side of the first gas transfer mechanism, has a thread groove on either one of opposing surfaces of the rotor portion and the stator portion, transfers, to the outlet port, the gas suctioned from the inlet port, and forms a clearance between thread groove convex surfaces formed in the thread groove and an opposing surface facing the thread groove convex surfaces, wherein the second gas transfer mechanism has a product contact avoidance structure in which a portion of the clearance is larger than a clearance between the thread groove convex surfaces formed on the inlet port side of the thread groove and the opposing surface facing the thread groove convex surfaces.

Claim 2 provides the vacuum pump according to claim 1, wherein the product contact avoidance structure has a structure in which each of the thread groove convex surfaces is cut by gradually increasing the amount of cutting each of the thread groove convex surfaces, from the thread groove convex surface formed on the inlet port side to the thread groove convex surface formed on the outlet port side.

Claim 3 provides the vacuum pump according to claim 1, wherein, in the second gas transfer mechanism, the product contact avoidance structure has a structure in which each of the thread groove convex surfaces, which are formed in a region of ½ of the second gas transfer mechanism in an axial direction, is cut from the outlet port side toward the inlet port side.

Claim 4 provides the vacuum pump according to claim 1, wherein the product contact avoidance structure has a structure in which the opposing surface facing the thread groove is cut by gradually increasing the amount of cutting the opposing surface, from the inlet port side toward the outlet port side.

Claim 5 provides the vacuum pump according to claim 1, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

Embodiments herein can provide a vacuum pump in which the period for deposited products to come into contact with the rotary portion or the stator portion is extended by changing only the diameter size of a lower portion of the thread groove portion in the rotary portion or stator portion having the thread grooves (by lengthening the operating life of the vacuum pump), to accordingly lengthen an interval for executing an overhaul.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION (i) Summary of Embodiments

Figure 1:
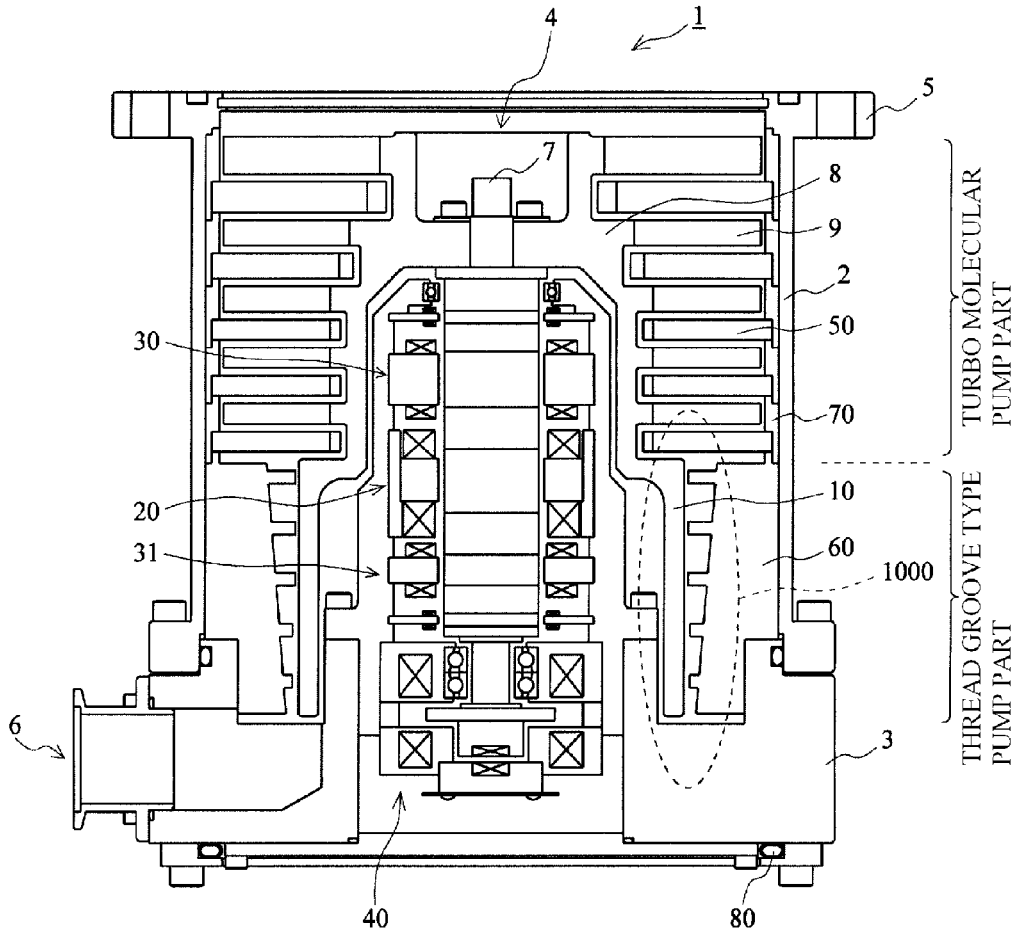
FIG. 1 is a diagram showing a schematic configuration example of a turbo molecular pump having a product contact avoidance structure according to a first embodiment of the present invention.

A vacuum pump according to an embodiment of the present invention is a thread groove type vacuum pump or a composite turbo molecular pump with a thread groove type pump portion, wherein, in a rotor blade cylindrical portion or a stator portion in which thread grooves are formed, a convex surfaces (explained as "thread groove peak surfaces" hereinafter) configuring higher sections of the thread grooves (peak sections, which are not the grooves) are cut by a desired amount over the entire circumference (a circumferential direction of the thread grooves) of a certain range in an axial direction.

Note that the amount of cutting is described hereinafter.

The following cases are considered: a case where the thread grooves are formed in the stator portion of the vacuum pump, and a case where the thread grooves are formed in the rotor blade cylindrical portion of the vacuum pump.

First, in the case where the thread grooves are formed in the stator portion, the lower side (i.e., the outlet port side) of a clearance is expanded, the clearance being configured by an outer circumferential surface of the rotor blade cylindrical portion and an inner circumferential surface of the stator portion formed by the thread groove peak surfaces (thread groove convex surfaces) of the stator portion (thread groove spacer), the inner circumferential surface facing the outer circumferential surface.

On the other hand, in the case where the thread grooves are formed in the rotor blade cylindrical portion, the lower side (i.e., the outlet port side) of a clearance is partially expanded, the clearance being configured by outer circumferential surfaces formed by thread groove peak surfaces of the rotor blade cylindrical portion and the stator portion facing the outer circumferential surfaces. In other words, in the vacuum pump of each embodiment of the present invention, thread groove valley surfaces of the thread grooves have a uniform depth, whereas the levels of the thread groove peak surfaces change uniformly, when viewing the whole thread grooves.

More specifically, in the case where the thread grooves are formed in the stator portion, the thread groove peak surfaces of the stator portion are cut by a desired amount in order to increase the size of an inner diameter of the lower side of the stator portion (the thread groove spacer). As a result, the lower side (the outlet port side) of the abovementioned clearance can be enlarged.

On the other hand, in the case where the thread grooves are formed in the rotary portion, the thread groove peak surfaces of the rotary portion are cut by a desired amount in order to reduce the size of an outer diameter of the lower side of the rotary portion. As a result, the lower side (the outlet port side) of the abovementioned clearance can be enlarged.

Alternatively, the side without the thread grooves (i.e., the surface facing the stator portion or the rotary portion in which the thread grooves are formed) is cut by a desired amount. As a result, the lower side (the outlet port side) of the abovementioned clearance can be enlarged.

In either case, the clearance on the lower side (outlet port side) of the thread groove portion can partially be enlarged by cutting the thread groove peak surfaces or the surfaces facing the thread grooves by a desired amount.

Note that the range of the lower side is described hereinafter.

(ii) Detail of Embodiments

Embodiments of the present invention are described hereinafter in detail with reference to FIGS. 1 to 14.

Note that a so-called composite turbo molecular pump having a turbo molecular pump portion (a first gas transfer mechanism) and a thread groove type pump portion (a second gas transfer mechanism) is used as an example of a vacuum pump to be described the present embodiments.

First of all, the case where the thread grooves are formed in the stator portion is described as a first embodiment with reference to FIGS. 1 to 10. Next, the case where the thread grooves are formed in the rotor blade cylindrical portion is described as a second embodiment with reference to FIGS. 11 to 14.

(ii-1) First Embodiment

First, a turbo molecular pump having the thread grooves thereof formed in a stator portion is described with reference to FIG. 1.

FIG. 1 is a diagram showing a schematic configuration example of a turbo molecular pump 1 having a product contact avoidance structure 1000 according to the first embodiment of the present invention. Note that FIG. 1 shows a cross-sectional diagram taken along an axial direction of the turbo molecular pump 1.

A casing 2 configuring a casing of the turbo molecular pump 1 has a substantially cylindrical shape and configures a housing of the turbo molecular pump 1 along with a base 3 provided in a lower portion (outlet port 6 side) of the casing 2. A gas transfer mechanism, a structure exerting an exhaust function of the turbo molecular pump 1, is accommodated inside the housing.

This gas transfer mechanism is basically configured by a rotary portion that is supported rotatably and a stator portion fixed to the housing.

An inlet port 4 for introducing gas to the turbo molecular pump 1 is formed at an end portion of the casing 2. A flange portion 5 that projects to an outer circumference of the casing 2 is formed at an end surface of the casing 2 on the inlet port 4 side.

The outlet port 6 for pumping out the gas from the turbo molecular pump 1 is formed at the base 3.

The rotary portion is configured by a shaft 7, which is a rotating shaft, a rotor 8 disposed on the shaft 7, a plurality of rotor blades 9 provided on the rotor 8, a tubular rotating member 10 provided on the outlet port 6 side (the thread groove type pump), and the like. Note that a rotor portion is configured by the shaft 7 and the rotor 8.

The rotor blades 9 are inclined by a predetermined angle from a plane perpendicular to an axis line of the shaft 7 and extend radially from the shaft 7.

The tubular rotating member 10 is a cylindrical member disposed concentrically with a rotating axis line of the rotor 8.

The middle of the axial direction of the shaft 7 is provided with a motor portion 20 for rotating the shaft 7 at high speed.

Furthermore, radial magnetic bearing devices 30, 31 for supporting the shaft 7 radially (in a radial direction) in a non-contact state are provided on the inlet port 4 side and the outlet port 6 side in relation to the motor portion 20 of the shaft 7. A lower end of the shaft 7 is provided with an axial magnetic bearing device 40 for supporting the shaft 7 in the axial direction (axial direction) in a non-contact state.

A stator portion is formed on the inner circumferential side of the housing. This stator portion is configured by a plurality of stator blades 50 provided on the inlet port 4 side (the turbo molecular pump portion), a thread groove spacer 60 provided on an inner circumferential surface of the casing 2, and the like.

The stages of stator blades 50 are inclined by a predetermined angle from a plane perpendicular to the axis line of the shaft 7 and extend from the inner circumferential surface of the housing toward the shaft 7.

The stages of stator blades 50 are fixed at intervals with cylindrical spacers 70 therebetween.

In the turbo molecular pump portion, the stator blades 50 and the rotor blades 9 are placed alternately in plurality of stages in the axial direction.

Spiral grooves are formed on an opposing surface of the thread groove spacer 60 that faces the tubular rotating member 10.

The thread groove spacer 60 faces an outer circumferential surface of the tubular rotating member 10 with a predetermined clearance therebetween. When the tubular rotating member 10 is rotated at high speed, gas compressed in the turbo molecular pump 1 is sent toward the outlet port 6 side while being guided by the thread grooves (the spiral grooves) by the rotation of the tubular rotating member 10. In other words, the thread grooves function as passages for transporting the gas. Because the thread groove spacer 60 and the tubular rotating member 10 face each other with the predetermined clearance therebetween, the gas transfer mechanism (the second gas transfer mechanism) for transferring the gas through the thread grooves is configured.

In order to lower the force of gas flowing backward toward the inlet port 4 side, this clearance is the smaller the better.

The direction of the spiral grooves of the thread groove spacer 60 is a direction towards the outlet port 6 when the gas is transported through the spiral grooves in a direction of rotation of the rotor 8.

The spiral grooves are formed so as to become shallow toward the outlet port 6. Thus, the gas transported through the spiral grooves is compressed more toward the outlet port 6. Therefore, the gas drawn through the inlet port 4 is compressed in the turbo molecular pump portion, thereafter further compressed in the thread groove type pump portion, and then pumped out from the outlet port 6.

Moreover, in such a case where the turbo molecular pump 1 is used for manufacturing a semiconductor as described above, steps of manufacturing a semiconductor include a large number of steps of causing various process gases to act on a substrate of the semiconductor. In this case, the turbo molecular pump 1 is used not only for creating a vacuum in a chamber but also for pumping out these process gases from the inside of the chamber.

In some cases these process gases not only have high pressure but also cooled and then become solid at a certain temperature when pumped out, resulting in precipitating products in an exhaust system.

When the temperatures of these process gases drop and consequently the process gases become solidified in the turbo molecular pump 1 and adhere and deposit on the inside of the turbo molecular pump 1, the resultant deposits narrow a pump passage, deteriorating the performance of the turbo molecular pump 1.

In order to prevent this situation, a temperature sensor (not shown) such as a thermistor is embedded in the base 3, and a heater (not shown) and a water jacketed pipe 80 can heat and cool the gas (TMS: Temperature Management System) to keep the temperature of the base 3 at a certain high temperature (set temperature) based on a signal from the temperature sensor.

The turbo molecular pump 1 with such a configuration executes an evacuation process in a vacuum chamber (not shown) disposed in the turbo molecular pump 1.

Here, the thread groove spacer 60 of the turbo molecular pump 1 according to the first embodiment of the present invention has the product contact avoidance structure 1000 for delaying the contact created between deposited products and the rotary portion (especially the tubular rotating member 10).

The product contact avoidance structure 1000 according to the first embodiment of the present invention is formed in a section in the thread groove spacer 60 where the pressure of the gas becomes high (i.e., the outlet port 6 side) and is configured to prevent deposited products from coming into contact with the rotary portion. The product contact avoidance structure 1000 can prevent deposited products and the tubular rotating member 10 from coming into contact with each other for a certain period of time. This can therefore not only prevent deterioration of the performance of the turbo molecular pump 1 but also lengthen a cycle of execution of an overhaul required by the turbo molecular pump 1.

Figure 2:
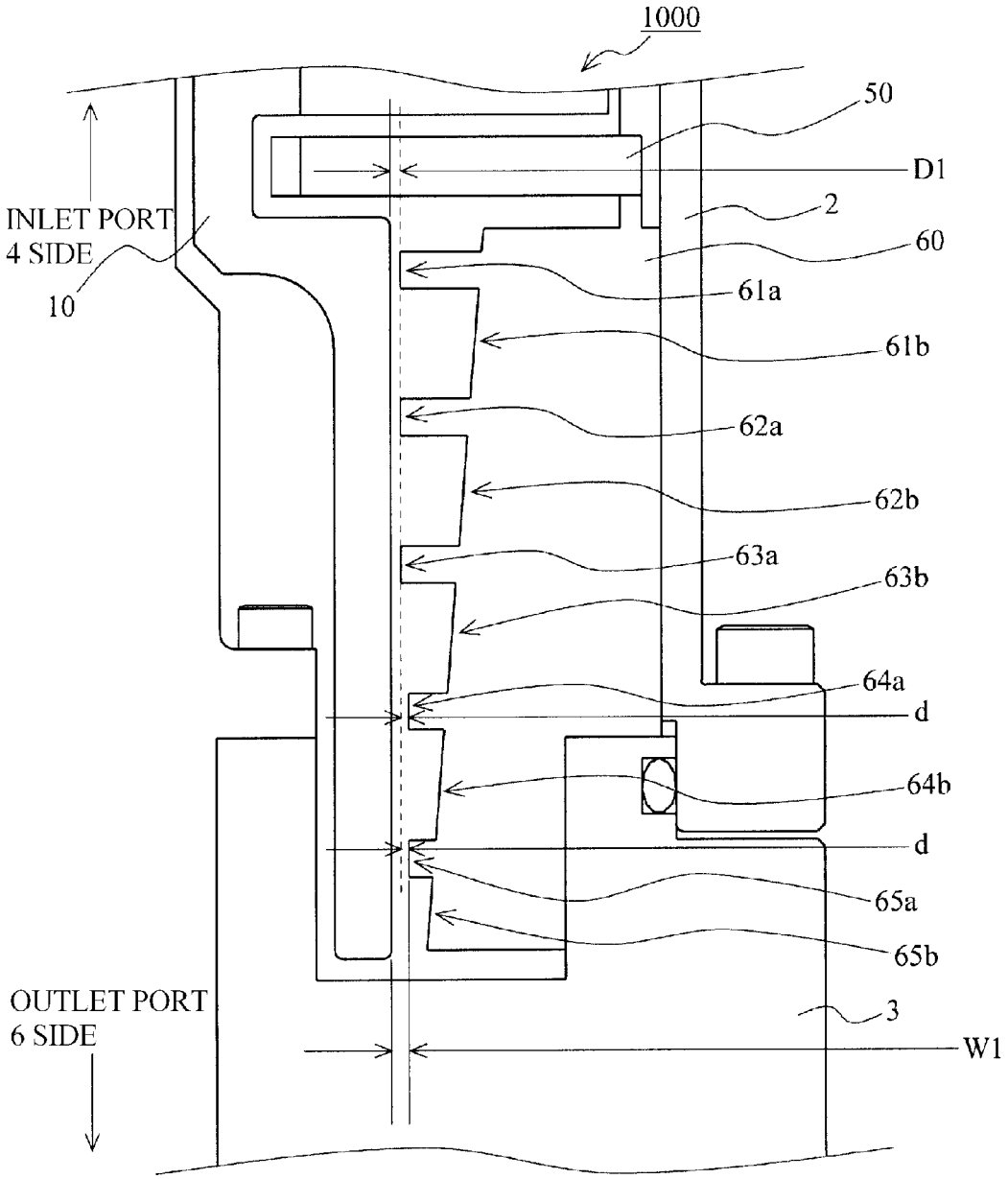
FIG. 2 is a cross-sectional diagram showing an example of the product contact avoidance structure according to the first embodiment of the present invention.

FIG. 2 is a cross-sectional diagram showing an example of the product contact avoidance structure 1000 according to the first embodiment of the present invention.

As shown in FIG. 2, the thread groove spacer 60 having the product contact avoidance structure 1000 according to the first embodiment of the present invention has spiral grooves that are formed in the form of spirals extending from the inlet port 4 side of the turbo molecular pump 1 towards the outlet port 6 side. Spiral groove peak surfaces 61*a*, 62*a*, 63*a*, 64*a* and 65*a* and spiral groove valley surfaces 61*b*, 62*b*, 63*b*, 64*b* and 65*b* represent thread grooves shown cross-sectionally in the axial direction.

The thread grooves configured respectively by a pair of the thread groove peak surface 61*a* and the thread groove valley surface 61*b*, a pair of the thread groove peak surface 62*a* and the thread groove valley surface 62*b*, a pair of the thread groove peak surface 63*a* and the thread groove valley surface 63*b*, a pair of the thread groove peak surface 64*a* and the thread groove valley surface 64*b*, and a pair of the thread groove peak surface 65*a* and the thread groove valley surface 65*b*, are formed to gradually become shallow toward the outlet port 6 side of the turbo molecular pump 1. In other words, the thread groove formed by the thread groove peak surface 61*a* and the thread groove valley surface 61*b* is deeper than the thread groove formed by the thread groove peak surface 65*a* and the thread groove valley surface 65*b*.

In the thread groove spacer 60 having the product contact avoidance structure 1000 according to the first embodiment of the present invention, D1 is a clearance between the tubular rotating member 10 and the thread groove peak surfaces 61*a*, 62*a* and 63*a* of the thread groove peak surfaces 61*a*, 62*a*, 63*a*, 64*a* and 65*a*, and W1 is a clearance between the tubular rotating member 10 and the thread groove peak surfaces 64*a* and 65*a*. The clearance W1 is larger than a clearance D1 by a dimension d. This dimension d, which is the difference between the clearances, can be secured by cutting the thread groove peak surfaces 64*a* and 65*a* by a dimension d (length equivalent to d).

The dimension d is set at approximately 0.35 mm in the first embodiment but is desirably set within a range of 0.1 mm to 0.5 mm in view of all conditions.

Due to the presence of the product contact avoidance structure 1000 in the turbo molecular pump 1 according to the first embodiment of the present invention, an inner diameter that is configured by the thread groove peak surface 64*a* and 65*a* on the lower side (the outlet port 6 side) of the thread groove spacer 60 is longer than an inner diameter that is configured by the thread groove peak surfaces 61*a*, 62*a* and 63*a* on the upper side (the inlet port 4 side) by a dimension d×2.

According to this configuration, the turbo molecular pump 1 of the first embodiment of the present invention can increase the size of only the clearance where products are likely to deposit (i.e., a region on the lower side of the thread groove type pump portion where the gas pressure is high and deposits easily accumulate). Consequently, the period for the deposited products to come into contact with the tubular rotating member 10 or the thread groove spacer 60 can be extended longer than ever before.

In addition, instead of changing the clearance between the thread groove peak surfaces on the upper side of the thread groove type pump portion (i.e., the region where products rarely deposit) and the tubular rotating member 10, the clearance on the lower side of the thread groove type pump portion (i.e., the region where the gas pressure is high and products are likely to deposit) is enlarged. Therefore, the clearance between the thread groove peak surfaces 61*a*, 62*a*, 63*a* and 64*a* and the tubular rotating member 10 becomes large in the entire spacer 60. As a result, significant deterioration of the performance of the turbo molecular pump 1 that is caused by a reflux of the gas from the clearance portion can be prevented.

The product contact avoidance structure according to the first embodiment of the present invention described above can be modified in various ways as follows.

(Modification 1 of the First Embodiment)

Figure 3:
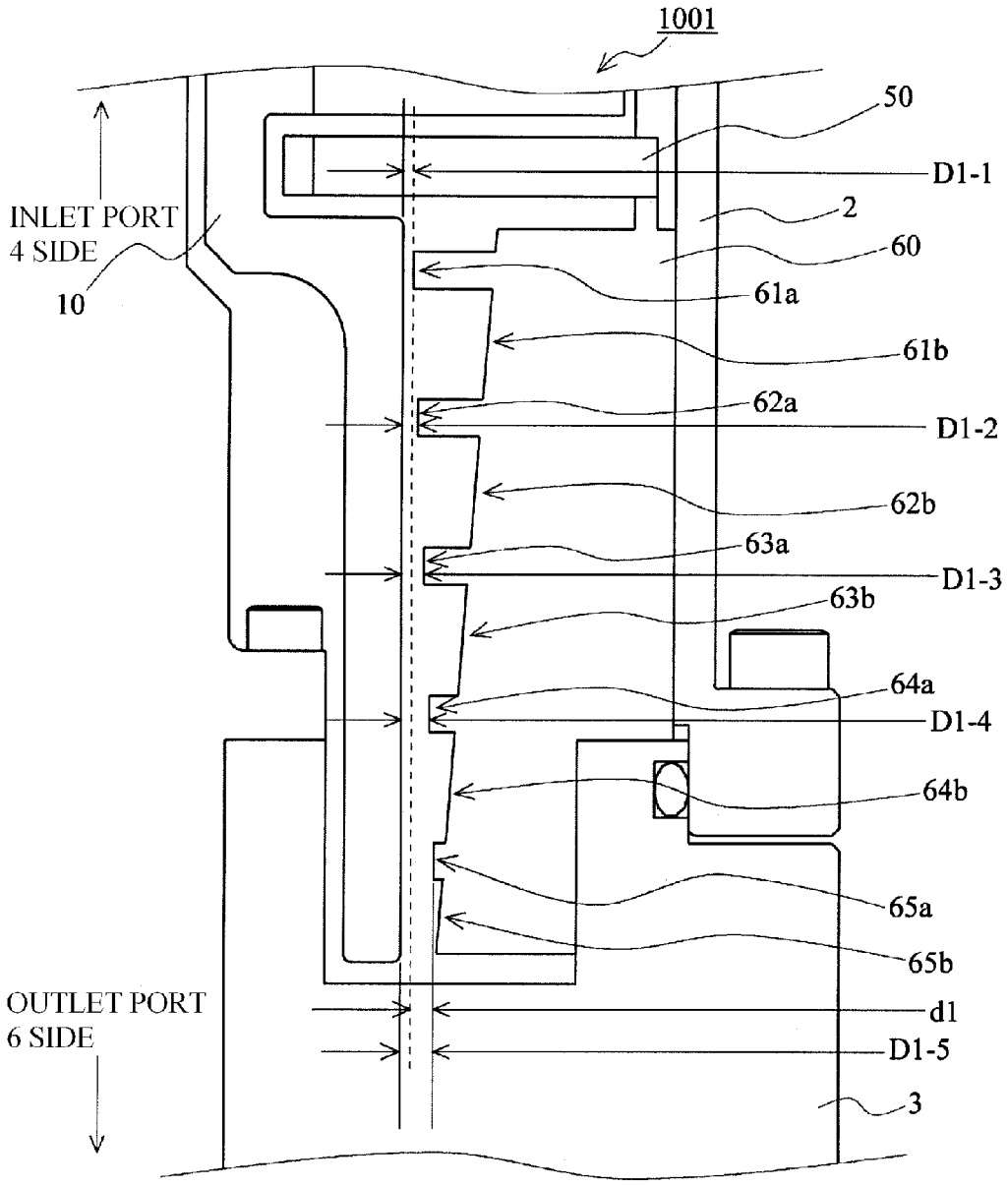
FIG. 3 is a cross-sectional diagram showing an example of a product contact avoidance structure according to a modification 1 of the first embodiment of the present invention.

FIG. 3 is a cross-sectional diagram showing a product contact avoidance structure 1001, which is a modification 1 of the product contact avoidance structure 1000 according to the first embodiment of the present invention.

As shown in FIG. 3, the thread groove spacer 60 with the product contact avoidance structure 1001 according to the modification 1 of the first embodiment of the present invention has spiral grooves that are formed in the form of spirals extending from the inlet port 4 of the turbo molecular pump 1 towards the outlet port 6 side, as in the product contact avoidance structure 1000.

In the thread groove spacer 60 with the product contact avoidance structure 1001 according to the modification 1, D1-1 is a clearance between the thread groove peak surface 61*a* and the tubular rotating member 10, and a clearance (D1-2) larger than the clearance (D1-1) is a clearance between the thread groove peak surface 62*a* and the tubular rotating member 10. A clearance (D1-3) larger than the clearance (D1-2) is a clearance between the thread groove peak surface 63*a* and the tubular rotating member 10. A clearance (D1-4) larger than the clearance (D1-3) is a clearance between the thread groove peak surface 64*a* and the tubular rotating member 10. A clearance (D1-5) larger than the clearance (D1-4) is a clearance between the thread groove peak surface 65*a* and the tubular rotating member 10. These clearances have configurations different from one another.

In other words, the clearance between the tubular rotating member 10 and each thread groove peak surface is formed to gradually become larger from the inlet port 4 side of the turbo molecular pump 1 toward the outlet port 6 side. The relationship among the sizes of these clearances is as follows: (D1-1)<(D1-2)<(D1-3)<(D1-4)<(D1-5).

The clearance (D1-5) that is formed at the bottom step on the outlet port 6 side in the thread groove spacer 60 having the product contact avoidance structure 1001 of the modification 1 is larger than the clearance (D-1) formed at the top step on the inlet port 4 side by, for example, approximately 0.35 mm (which is desirably set within a range of 0.1 mm to 0.5 mm in view of all conditions).

In so doing, in two adjacent thread groove peak surfaces (e.g., the thread groove peak surface 61*a* and the thread groove peak surface 62*a*) among the thread groove peak surfaces 61*a*, 62*a*, 63*a*, 64*a* and 65*a*, the clearances are formed by slightly increasing the amount of cutting the thread groove peak surface (e.g., the thread groove peak surface 62*a*) positioned below (on the outlet port 6 side) the thread groove peak surface (e.g., the thread groove peak surface 61*a*) positioned in an upper step (the inlet port 4 side).

In other words, the amount of cutting the thread groove peak surfaces of the thread groove spacer 60 of the product contact avoidance structure 1001 according to the modification 1 increases gradually toward the outlet port 6 side.

As a result, the lowermost thread groove peak surface 65*a* is cut more than the uppermost thread groove peak surface 61*a*, and consequently the clearance between the thread groove peak surface 65*a* and the opposing tubular rotating member 10 becomes larger than the clearance between the thread groove peak surface 61*a* and the tubular rotating member 10 by a dimension d1 (length equivalent to d1).

In the product contact avoidance structure 1001 according to the modification 1, the inner diameter configured by the thread groove peak surface 65*a* on the lower side (the outlet port 6 side) of the thread groove spacer 60 is longer than the inner diameter configured by the thread groove peak surface 61*a* on the upper side (the inlet port 4 side) by a dimension d1×2. Thus, the clearances gradually become larger from the upper side toward the lower side.

According to the turbo molecular pump 1 having the product contact avoidance structure 1001 of the modification 1, the clearances between the thread groove peak surfaces 61*a*, 62*a*, 63*a*, 64*a* and 65*a* and the tubular rotating member 10 gradually become larger from the upper side of the thread groove type pump portion (i.e., the region where products rarely deposit) toward the lower side of the thread groove type pump portion (i.e., the region where the gas pressure is high and products are likely to deposit). This configuration can extend, longer than ever before, the period for the products deposited on the thread groove spacer 60 to come into contact with the tubular rotating member 10 where the vacuum pump is distorted particularly significantly in the direction toward the outlet port 6 side due to the thermal expansion or creep phenomenon, or the period for the products deposited on the tubular rotating member 10 to come into contact with the thread groove spacer 60.

Furthermore, instead of changing the clearance between the thread groove peak surfaces on the upper side of the thread groove type pump portion (i.e., the region where products rarely deposit) and the tubular rotating member 10, the clearances are formed to gradually become larger toward the lower side of the thread groove type pump portion (the region where the gas pressure is high and products are likely to deposit). Therefore, the clearances between the thread groove peak surfaces 61*a*, 62*a*, 63*a* and 64*a* and the tubular rotating member 10 become larger in the whole spacer 60. Thus, significant deterioration of the performance of the turbo molecular pump 1 that is caused by a reflux of the gas from the clearance portions can be prevented.

In the configuration of the modification 1, the clearances between the thread groove peak surfaces 61*a*, 62*a*, 63*a*, 64*a* and 65*a* and the tubular rotating member 10 are formed to gradually become larger; however, the present invention is not limited to this configuration.

For instance, as long as the inner diameter on the lower side (the outlet port 6 side) of the thread groove spacer 60 in the axial direction is wider than the inner diameter on the upper side (the inlet port 4 side), the thread groove peak surfaces may be divided into an upper-half group and a lower-half group, to configure two stages of thread groove peak surfaces. In other words, the composition ratio between the thread groove peak surface groups of the thread groove spacer 60 in this case is 1:1 in the axial direction.

Or, the thread groove peak surfaces may be divided into three stages: an upper ⅓ group, a middle ⅓ group, and a lower ⅓ group. In other words, the composition ratio among the thread groove peak surface groups of the thread groove spacer 60 in this case is 1:1:1 in the axial direction.

(Modification 2 of the First Embodiment)

Figure 4:
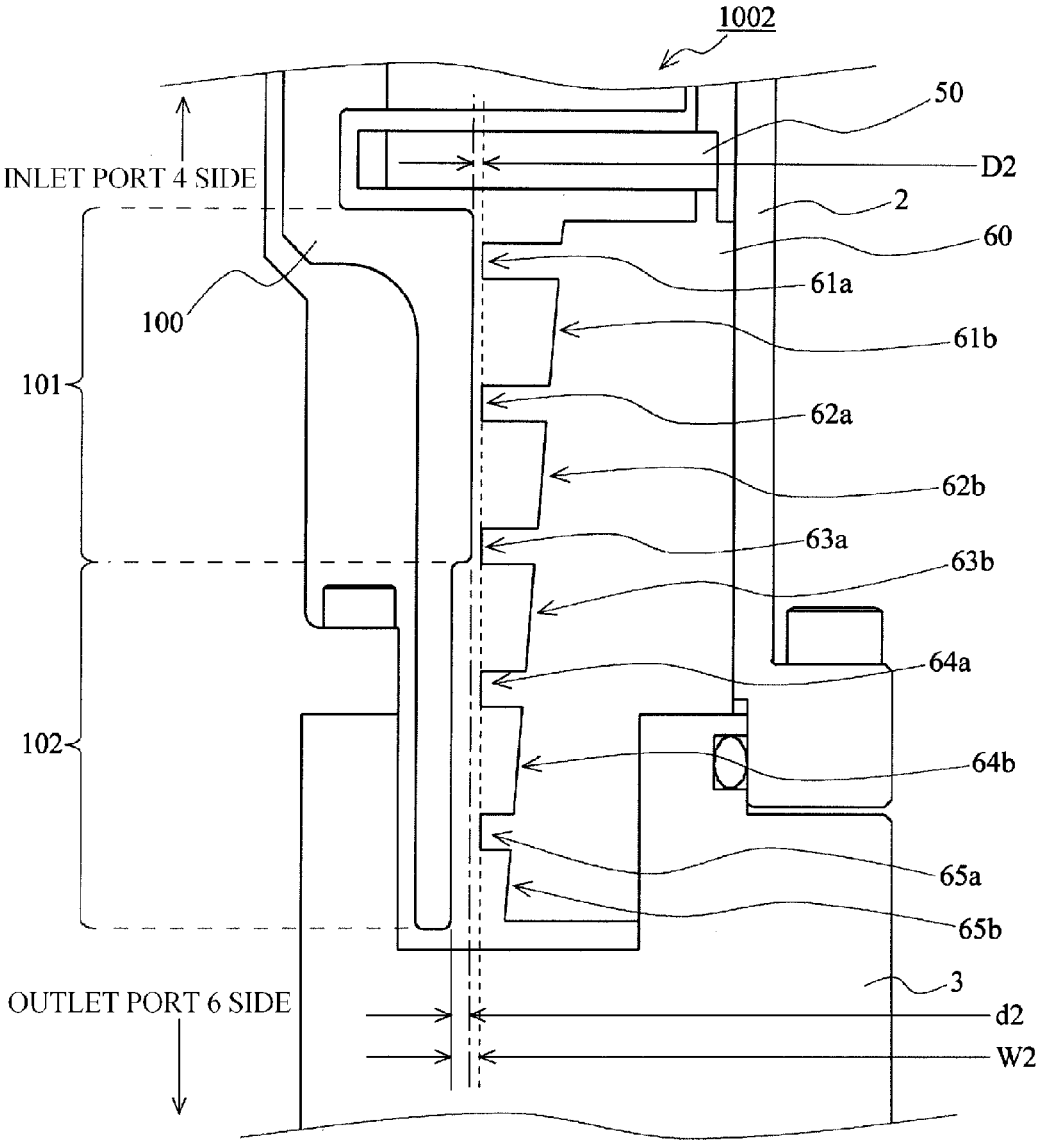
FIG. 4 is a cross-sectional diagram showing an example of a product contact avoidance structure according to a modification 2 of the first embodiment of the present invention.

FIG. 4 is a cross-sectional diagram showing a product contact avoidance structure 1002, which is a modification 2 of the first embodiment of the present invention.

As shown in FIG. 4, the thread groove spacer 60 according to the modification 2 of the first embodiment of the present invention has spiral grooves that are formed in the form of spirals extending from the inlet port 4 side of the turbo molecular pump 1 towards the outlet port 6 side.

In the product contact avoidance structure 1002 according to the modification 2, of the thread groove peak surfaces 61*a*, 62*a*, 63*a*, 64*a* and 65*a*, the thread groove peak surfaces on the inlet port 4 side (e.g., the thread groove peak surfaces 61*a*, 62*a* and 63*a*) face a long outer diameter portion 101 of a tubular rotating member 100 with a clearance D2 therebetween. The thread groove peak surfaces on the outlet port 6 side (e.g., the thread groove peak surfaces 64*a* and 65*a*) face a short outer diameter portion 102 of the tubular rotating member 100 with a clearance W2 larger than the clearance D2 therebetween.

According to this configuration, the outer diameters of the tubular rotating member 100 according to the modification 2 of the first embodiment of the present invention are not constant in the axial direction and are designed such that the outer diameter on the inlet port 4 side is different from the outer diameter on the outlet port 6 side, so that the clearance (W2) on the outlet port 6 side becomes larger than the clearance (D2) on the inlet port 4 side.

More specifically, as shown in FIG. 4, the tubular rotating member 100 according to the modification 2 of the first embodiment of the present invention has the long outer diameter portion 101 on the inlet port 4 side where products rarely deposit (e.g., the upper half of the tubular rotating member 100), the long outer diameter portion 101 facing the thread groove peak surface 61*a* with the clearance D2 therebetween, and the short outer diameter 102 on the outlet port 6 side where the gas pressure is high and products are likely to deposit (e.g., the lower half of the tubular rotating member 100), the short outer diameter portion 102 being shorter than the long outer diameter portion 101.

According to the configuration of the product contact avoidance structure 1002 of the modification 2 of the first embodiment of the present invention, the clearance (W2) on the outlet port 6 side is larger than the clearance D2 by a dimension d2, which is a radius difference between the long outer diameter portion 101 and the short outer diameter portion 102 (this dimension is d2×2 in terms of diameter).

Note that the dimension d2 is set at approximately 0.35 mm in this modification, but can also be set within a range of 0.1 mm to 0.5 mm in view of all conditions.

Because the turbo molecular pump 1 according to the modification 2 has the product contact avoidance structure 1002 that has the long outer diameter portion 101 and the short outer diameter portion 102 in the tubular rotating member 100, only the clearance (W2) of the section where products are likely to deposit (i.e., the lower side of the tubular rotating member 100 where the gas pressure is high) can be enlarged, and the period for the deposited products to come into contact with the tubular rotating member 100 or the thread groove spacer 60 can be extended longer than ever before.

Moreover, instead of changing the clearance between the tubular rotating member 100 and the thread groove peak surfaces on the upper side of the thread groove spacer 60 (i.e., the region where products rarely deposit), the clearance on the lower side of the thread groove spacer 60 (i.e., the region where the gas pressure is high and products are likely to deposit) is partially enlarged. Thus, the clearances between the thread groove peak surfaces 61*a*, 62*a*, 63*a* and 64*a* and the tubular rotating member 100 can be made large in the entire thread groove spacer 60, preventing the performance of the turbo molecular pump 1 from being deteriorated significantly as a result of a reflex of the gas from the clearance portions.

Note in the modification 2 that the tubular rotating member 100 has the two-stage configuration in which the long outer diameter portion 101 is formed in the upper half on the inlet port 4 side and the short outer diameter portion 102 in the lower half on the outlet port 6 side; however, the present invention is not limited to this configuration.

For instance, as long as the outer diameter on the lower side (the outlet port 6 side) of the tubular rotating member 100 in the axial direction is smaller than the outer diameter on the upper side (the inlet port 4 side), the tubular rotating member 100 may have a three-stage configuration of three different consecutive outer diameter portions: a long outer diameter portion in ⅓ of the tubular rotating member from the upper side toward the lower side, a short outer diameter portion in ⅓ of the tubular rotating member from the lower side toward the upper side, and a middle outer diameter portion in ⅓ of the tubular rotating member, between the long outer diameter portion and the short outer diameter portion, the middle outer diameter portion being smaller than the long outer diameter portion and larger than the short outer diameter. In other words, the composition ratio among these diameter portions in this case is 1:1:1 in the axial direction of the tubular rotating member 100.

Or, the tubular rotating member 100 may have a two-stage configuration of consecutive diameter portions: a long outer diameter portion in ¾ of the tubular rotating member from the upper side toward the lower side, and a short outer diameter portion from an end section of the long outer diameter portion toward the lower side (i.e., in ¼ of the tubular rotating member from the lower side toward the upper side). In other words, the composition ratio between these diameter portions in this case is 3 (upper side):1 (lower side) in the axial direction of the tubular rotating member 100.

(Modification 3 of the First Embodiment)

Figure 5:
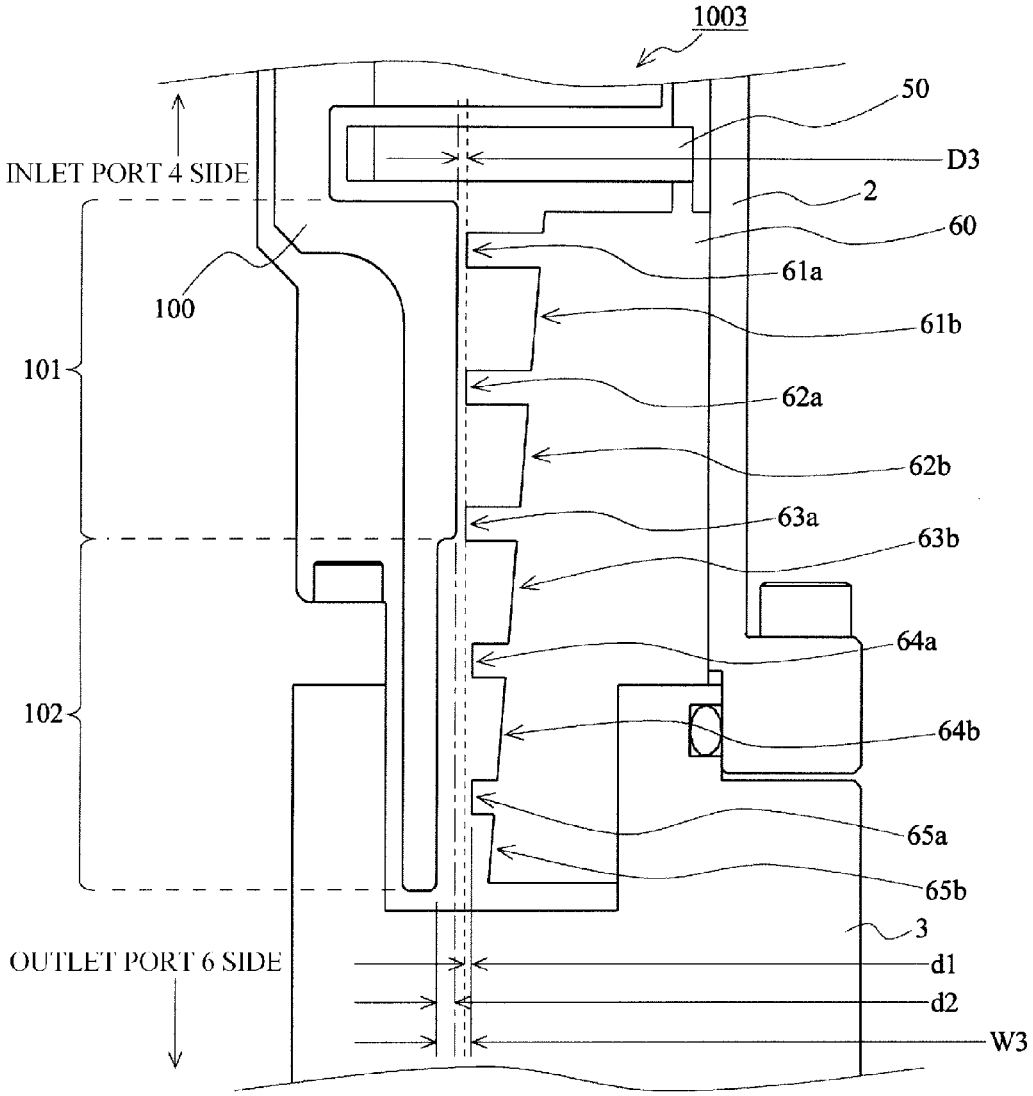
FIG. 5 is a cross-sectional diagram showing an example of a product contact avoidance structure according to a modification 3 of the first embodiment of the present invention.

FIG. 5 is a cross-sectional diagram showing a product contact avoidance structure 1003, which is a modification 3 of the first embodiment of the present invention.

As shown in FIG. 5, the tubular rotating member 100 of the product contact avoidance structure 1003 according to the modification 3 has, as with the modification 2, the long outer diameter portion 101 and the short outer diameter portion 102 that is different from the long outer diameter portion 101 by the radius difference dimension d2. This dimension d2 is set at, for example, approximately 0.35 mm in the modification 3, but can also be set within a range of 0.1 mm to 0.5 mm in view of all conditions.

Of the thread groove peak surfaces 61*a*, 62*a*, 63*a*, 64*a* and 65*a* of the thread groove spacer 60 in the product contact avoidance structure 1003 according to the modification 3, the thread groove peak surfaces 64*a* and 65*a* facing the short outer diameter portion 102 of the tubular rotating member 100 are formed such that the clearance between these surfaces and the short outer diameter 102 gradually becomes larger from the upper side (the inlet port 4 side) toward the lower side (the outlet port 6 side). The amount d1 of cutting the thread groove peak surface 65*a* formed at the lowermost end is set at, for example, approximately 0.35 mm (but also can be set within a range of 0.1 mm to 0.5 mm in view of all conditions). Note that a clearance difference can be provided between the thread groove peak surface 64*a* and the thread groove peak surface 65*a* by setting the amount of cutting the thread groove peak surface 64*a* at a value smaller than the dimension d1.

With such a configuration of the product contact avoidance structure 1003 according to the modification 3, a clearance D3 is formed between each of the thread groove peak surfaces 61*a*, 62*a* and 63*a* on the inlet port 4 side and the long outer diameter portion 101, and a clearance W3 is formed between the thread groove peak surface 65*a* on the outlet port 6 side and the short outer diameter portion 102, as shown in FIG. 5. In other words, this clearance W3 is equivalent to the sum of the dimension d2, which is the difference between the long outer diameter portion 101 and the short outer diameter portion 102, the clearance D3 between the long outer diameter portion 101 and the thread groove peak surface 61*a* on the inlet port 4 side (in the uppermost position), and the dimension d1, which is the difference between the thread groove peak surface 61*a* on the inlet port 4 side (in the uppermost position) and the thread groove peak surface 65*a* on the outlet port 6 side (in the lowermost position).

In the turbo molecular pump 1 having the product contact avoidance structure 1003 of the modification 3 described above, the clearance between the tubular rotating member 100 and the thread groove spacer 60 at substantially the upper half of the thread groove type pump portion (i.e., the region where products rarely deposit) is kept constant, and the clearance between the tubular rotating member 100 and the thread groove spacer 60 at substantially the lower half of the thread groove type pump portion (i.e., the region where the gas pressure is high and products are likely to deposit) is formed to gradually become larger. For this reason, a sufficient clearance can be secured in the region where the gas pressure is high and deposits are likely to accumulate.

This configuration can extend, longer than ever before, the period for the products deposited on the lower side of the thread groove type pump portion to come into contact with the tubular rotating member 100 where the vacuum pump is distorted particularly significantly in the direction toward the outlet port 6 due to the thermal expansion or creep phenomenon, or the period for the products deposited on the tubular rotating member 100 to come into contact with the thread groove spacer 60.

In addition, because the clearance between the tubular rotating member 100 and the thread groove spacer 60 in substantially the upper half of the thread groove type pump portion is not changed, significant deterioration of the performance of the turbo molecular pump 1 can be prevented, while extending the period for the tubular rotating member 100 and the deposited products to come into contact with each other.

Note in the configuration described in the modification 3 that the thread grooves on the lower side of the thread groove spacer 60 are configured by making the amount of cutting each of the thread groove peak surfaces 64*a* and 65*a* increase slightly and gradually from the inlet port 4 side toward the outlet port 6 side; however, the present invention is not limited to this configuration.

For instance, as long as the inner diameter on the lower side (the outlet port 6 side) of the thread groove spacer 60 in the axial direction is longer than the inner diameter on the upper side (the inlet port 4 side), all of the thread groove peak surfaces may be formed in a step-like manner (i.e., the thread groove peak surfaces of the respective thread grooves form steps in the axial direction).

(Modification 4 of the First Embodiment)

Figure 6:
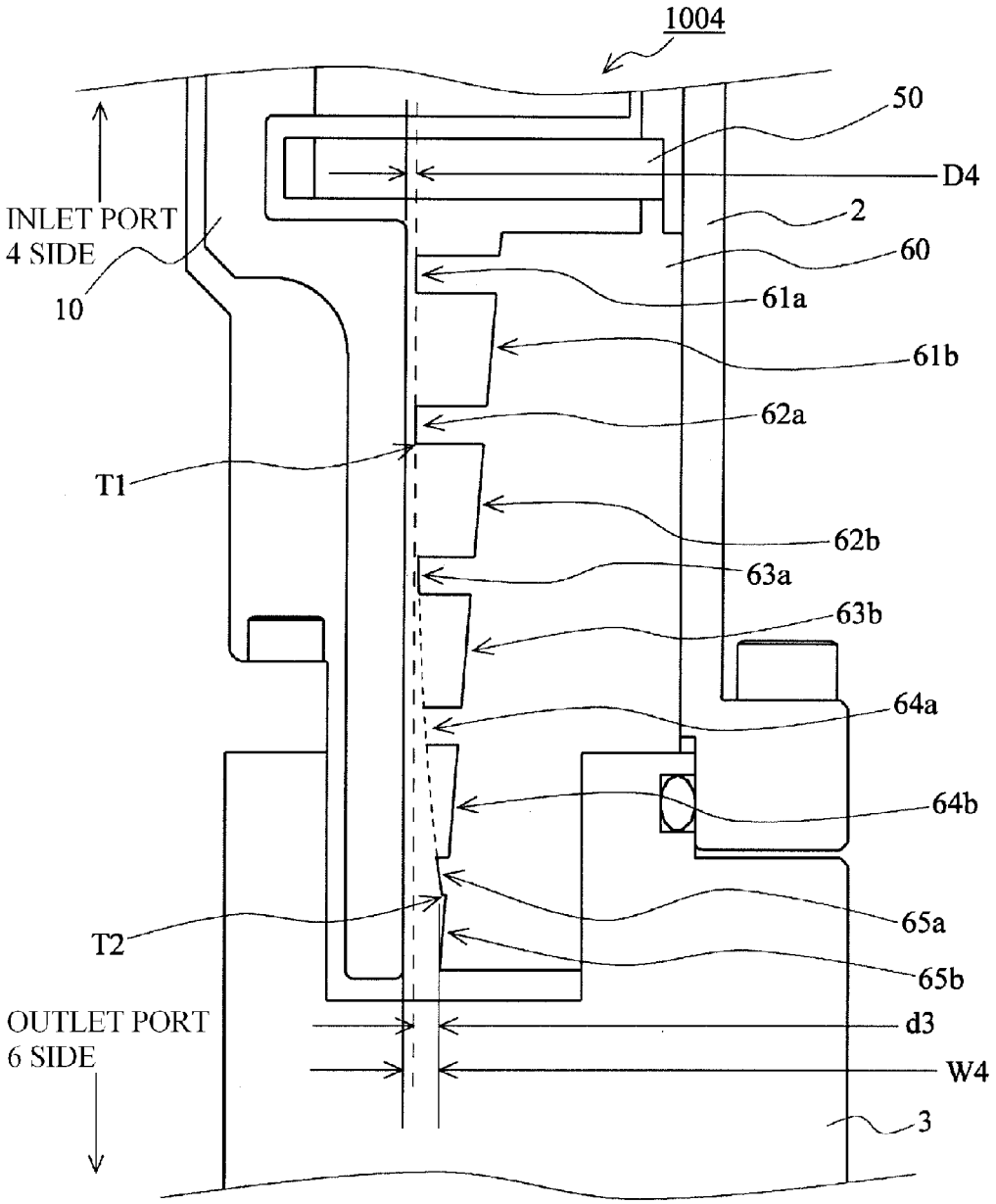
FIG. 6 is a cross-sectional diagram showing an example of a product contact avoidance structure according to a modification 4 of the first embodiment of the present invention.

FIG. 6 is a cross-sectional diagram showing an example of a product contact avoidance structure 1004 according to a modification 4 of the first embodiment of the present invention.

As shown in FIG. 6, the thread groove spacer 60 according to the product contact avoidance structure 1004 of the modification 4 has spiral grooves that are formed in the form of spirals extending from the inlet port 4 side of the turbo molecular pump 1 towards the outlet port 6 side.

Of the thread groove peak surfaces 61*a*, 62*a*, 63*a*, 64*a* and 65*a* in the product contact avoidance structure 1004 according to the modification 4, the thread groove peak surfaces positioned on the inlet port 4 side (e.g., the thread groove peak surfaces 61*a* and 62*a*) face the tubular rotating member 10 linearly with a clearance D4 therebetween, and the thread groove peak surfaces positioned on the outlet port 6 side (e.g., the thread groove peak surfaces 63*a*, 64*a* and 65*a*) face the tubular rotating member 10 in such a manner as to draw a fan-shaped curved line from the inlet port 4 side toward the outlet port 6 side.

In other words, while the thread groove peak surfaces 61*a* and 62*a* are formed into a planar shape, the thread groove peak surfaces 63*a*, 64*a* and 65*a* are formed into curves.

Specifically, while the thread groove peak surfaces 61*a* and 62*a* face the tubular rotating member 10 with the clearance D4 therebetween so as to be parallel with the tubular rotating member 10, the thread groove peak surfaces 63*a*, 64*a* and 65*a* are formed by being cut off by a desired amount so as to face the tubular rotating member 10 in the form of a curve, with an irregular clearance therebetween (i.e., with a clearance that gradually becomes larger).

According to this configuration, a dimensional difference d3 is formed between an end portion T1 of the thread groove peak surface (e.g., the thread groove peak surface 62*a*) facing the tubular rotating member 10 in parallel and an end portion T2 of the thread groove peak surface 65*a* on the outlet port 6 side, the thread groove peak surface 65*a* being located at the lowermost end on the outlet port 6 side. This dimensional difference d3 is set at, for example, approximately 0.35 mm in the modification 4, but can also be set within a range of 0.1 mm to 0.5 mm in view of all conditions.

In the product contact avoidance structure 1004 according to the modification 4, a clearance (W4) that is larger than the clearance (D4) on the inlet port 4 side by the dimensional size d3 can be formed on the outlet port 6 side. As described above, in the turbo molecular pump 1 having the product contact avoidance structure 1004 according to the modification 4, instead of changing the clearance (D4) between the tubular rotating member 10 and the thread groove peak surfaces on the upper side of the thread groove spacer 60 (i.e., the region where products rarely deposit), the clearance (W4) on the lower side of the thread groove spacer 60 (i.e., the region where the gas pressure is high and products are likely to deposit) is partially enlarged. Therefore, the clearances between the thread groove peak surfaces 61*a*, 62*a*, 63*a* and 64*a* and the tubular rotating member 10 become larger throughout the entire spacer 60. Consequently, while preventing significant deterioration of the performance of the turbo molecular pump 1, which can be caused by a reflux of the gas from the clearance portions, the period for the deposited products to come into contact with the tubular rotating member 10 or the thread groove spacer 60 can be extended longer than ever before.

(Modification 5 of the First Embodiment)

In addition to the thread groove spacer 60 of the product contact avoidance structure 1004 according to the modification 4, a tubular rotating member 110 that is structured to continuously taper the outer diameter on the lower-half side (the outlet port 6 side) of the tubular rotating member can be provided.

Figure 7:
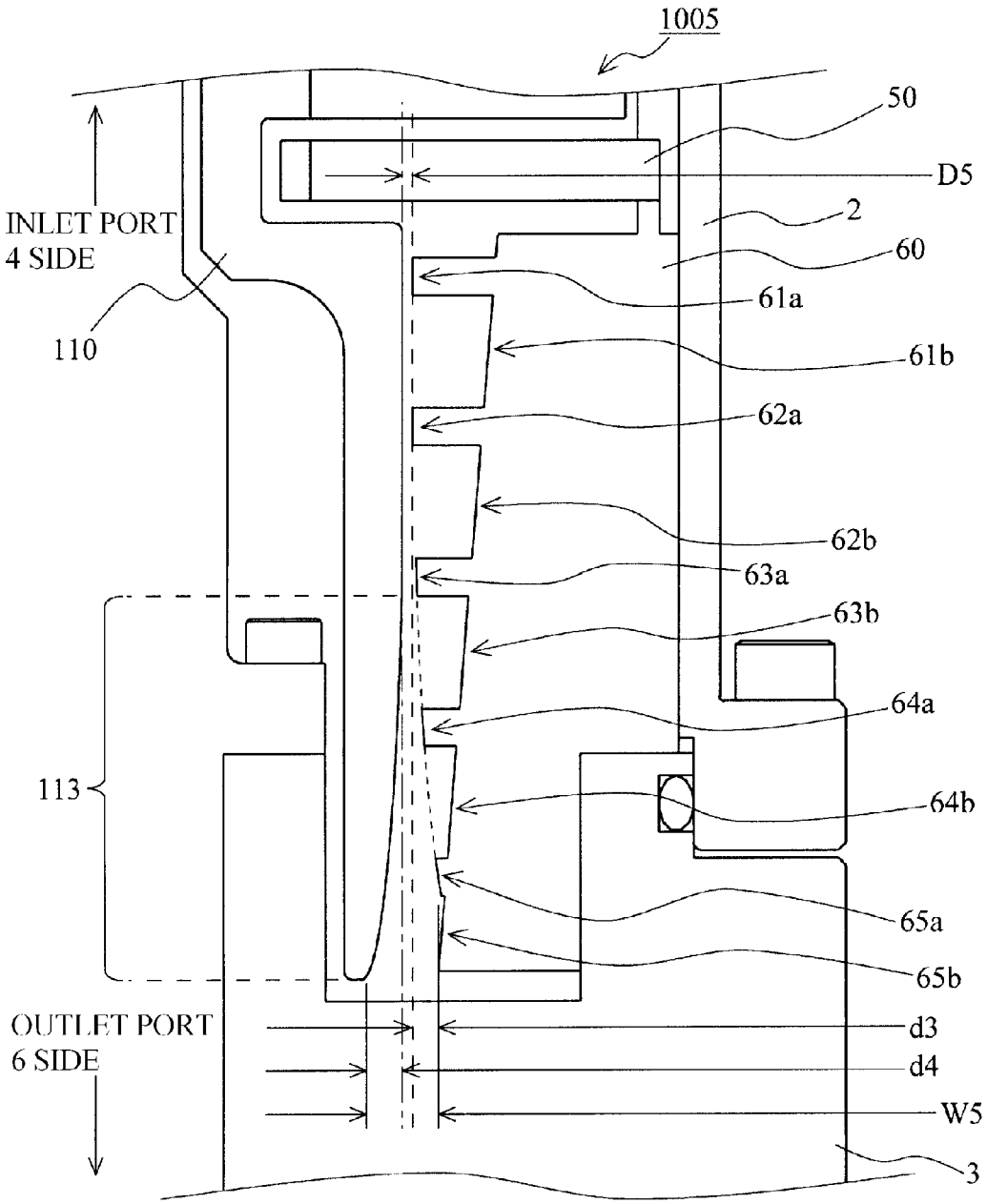
FIG. 7 is a cross-sectional diagram showing an example of a product contact avoidance structure according to a modification 5 of the first embodiment of the present invention.

FIG. 7 is a cross-sectional diagram showing an example of a product contact avoidance structure 1005 according to a modification 5 of the first embodiment of the present invention.

As shown in FIG. 7, the product contact avoidance structure 1005 according to the modification 5 has the tubular rotating member 110 in which a tapering outer diameter portion 113 is formed.

Specifically, in the product contact avoidance structure 1005 according to the modification 5, the tapering outer diameter portion 113 is formed in the lower half (½) section (on the outlet port 6 side) of the tubular rotating member 110 such that the outer diameter of the tubular rotating member 110 gradually becomes small (i.e., tapers) from the inlet port 4 side toward the outlet port 6 side.

According to this configuration, a dimensional difference d4 shown in FIG. 7 is formed between a constant diameter of the tubular rotating member 110 on the inlet port 4 side and the outer diameter of an open mouth of the tubular rotating member 110 on the outlet port 6 side (i.e., on the outlet port 6 side of the tapering outer diameter portion 113). This dimensional difference d4 is set at, for example, approximately 0.35 mm in the modification 5, but can also be set within a range of 0.1 mm to 0.5 mm in view of all conditions.

In the product contact avoidance structure 1005 according to the modification 5 described above, a clearance (W5), which is, in relation to the clearance (D5) on the inlet port 4 side, equivalent to the sum of the dimensional difference d3 formed in the thread groove spacer 60 and the dimensional difference d4 formed on the tubular rotating member 110 (the tapering outer diameter portion 113) side can be formed on the outlet port 6 side.

Note, in the product contact avoidance structure 1005 according to the modification 5, that the region of the tubular rotating member 110 in which the tapering outer diameter portion 113 is formed is equal to or less than half (½) the tubular rotating member 110; however the present invention is not limited to this configuration.

For instance, as long as the outer diameter on the lower side (the outlet port 6 side) of the tubular rotating member 110 in the axial direction is smaller than the outer diameter on the upper side (the inlet port 4 side), the tubular rotating member 110 may have the tapering outer diameter portion 113 in a region of ⅓ of the tubular rotating member, from the lower side toward the upper side. In other words, the composition ratio in this case is 2 (upper side):1 (lower side) in the axial direction of the tubular rotating member 110.

Alternatively, the tapering outer diameter portion 113 can be provided in a region of ¾ of the tubular rotating member from the lower side toward the upper side. In other words, the composition ratio in this case is 1 (upper side):3 (lower side) in the axial direction of the tubular rotating member 110.

As described above, in the turbo molecular pump 1 having the product contact avoidance structure 1005 according to the modification 5, instead of changing the clearance (D5) between the tubular rotating member 110 on the inlet port 4 side and the thread groove spacer 60 (thread groove peak surfaces) in the region where the tubular rotating member 110 and the thread groove spacer 60 face each other, the clearance (W5) on the outlet port 6 side is enlarged. Thus, while preventing significant deterioration of the performance of the turbo molecular pump 1, which is caused by a reflux of the gas as a result of expanding the clearance on the inlet port 4 side where products rarely deposit, the period for the deposited products in the region where the gas pressure is high and products are likely to deposit, to come into contact with the tubular rotating member 110 (the tapering outer diameter portion 113) or the thread groove spacer 60, can be extended longer than ever before.

(Modification 6 of the First Embodiment)

Figure 8:
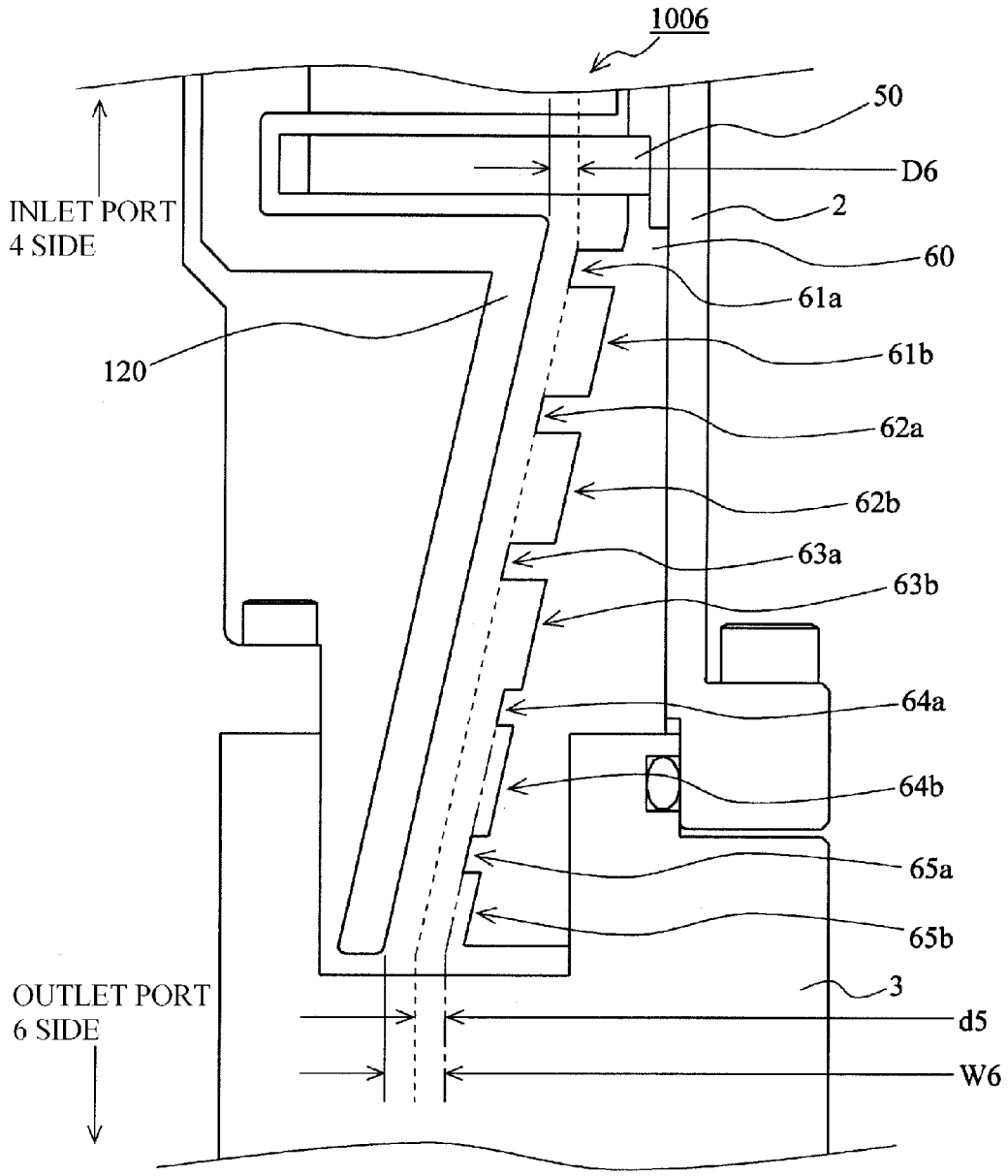
FIG. 8 is a cross-sectional diagram showing an example of a product contact avoidance structure according to a modification 6 of the first embodiment of the present invention.

FIG. 8 is a cross-sectional diagram showing an example of a product contact avoidance structure 1006 according to a modification 6 of the first embodiment of the present invention.

As shown in FIG. 8, an outer circumference of the product contact avoidance structure 1006 according to the modification 6 has a cone-shaped rotating member 120 having a tip of its cone positioned on the outlet port 6 side, and an inner circumference of the product contact avoidance structure 1006 has the thread groove spacer 60 that has the thread groove peak surfaces 61*a*, 62*a*, 63*a*, 64*a* and 65*a* and the thread groove valley surfaces 61*b*, 62*b*, 63*b*, 64*b* and 65*b* that oppose (face) an outer circumferential surface of the cone-shaped rotating member 120 via predetermined clearances therebetween.

As shown in FIG. 8, D6 is a radial clearance formed between the cone-shaped rotating member 120 and its opposing thread groove peak surfaces 61*a*, 62*a* and 63*a* on the inlet port 4 side out of the thread groove peak surfaces 61*a*, 62*a*, 63*a*, 64*a* and 65*a* of the thread groove spacer 60 having the product contact avoidance structure 1006 of the modification 6. A clearance W6, larger than the clearance D6 by a dimension d5 (e.g., 0.35 mm), is a radial clearance between the cone-shaped rotating member 120 and the thread groove peak surfaces 64*a* and 65*a* formed on the outlet port 6 side. The dimension d5, which is the difference between these clearances, can be secured by cutting the thread groove peak surfaces 64*a* and 65*a* by the dimension d5 (length equivalent to d5).

Note in the modification 6 that the dimension d5 is set at 0.35 mm, but can also be set within a range of 0.1 mm to 0.5 mm in view of all conditions.

Due to the presence of the product contact avoidance structure 1006 in the turbo molecular pump 1 according to the modification 6 described above, the radial clearance (W6) between the cone-shaped rotating member 120 and the thread groove spacer 60 on the lower side (the outlet port 6 side) of the thread groove spacer 60 is larger than the radial clearance (D6) between the cone-shaped rotating member 120 and the thread groove spacer 60 on the upper side (the inlet port 4 side) by the dimension d5.

Thus, in the turbo molecular pump 1 having the product contact avoidance structure 1006 according to the modification 6, the radial clearance (W6) on the outlet port 6 side is enlarged, without changing the radial clearance (D6) between the tubular rotating member 120 and the thread groove spacer 60 (the thread groove peak surfaces) on the inlet port 4 side in the region where the tubular rotating member 120 and the thread groove spacer 60 face each other.

As a result, while preventing significant deterioration of the performance of the turbo molecular pump 1, which is caused by a reflux of the gas as a result of enlarging the clearance on the inlet port 4 side where products rarely deposit, the period for the deposited products in the region where the gas pressure is high and products are likely to deposit, to come into contact with the tubular rotating member 120 or the thread groove spacer 60, can be extended longer than ever before.

(Modification 7 of the First Embodiment)

Figure 9:
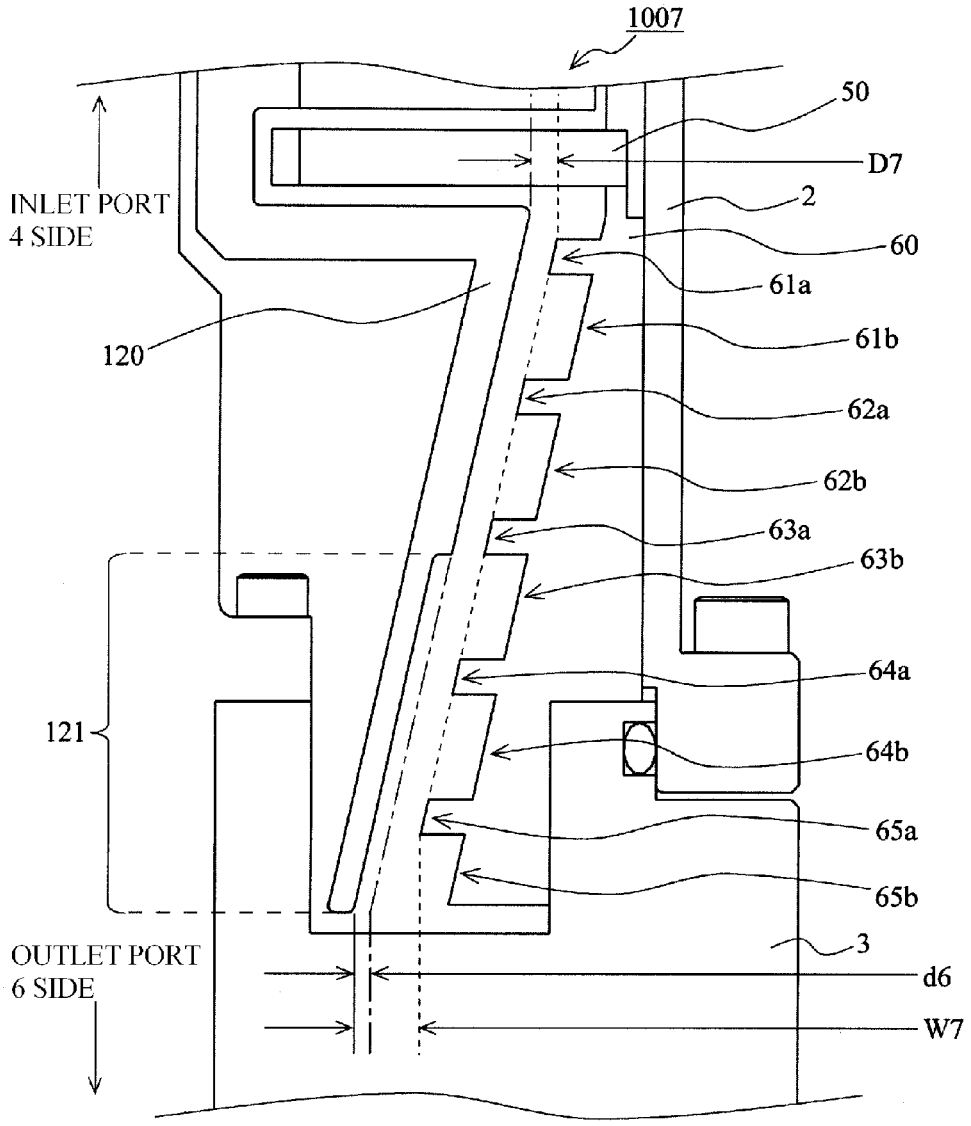
FIG. 9 is a cross-sectional diagram showing an example of a product contact avoidance structure according to a modification 7 of the first embodiment of the present invention.

FIG. 9 is a cross-sectional diagram showing an example of a product contact avoidance structure 1007 according to the modification 7 of the first embodiment of the present invention.

As shown in FIG. 9, an outer circumference of the product contact avoidance structure 1007 according to the modification 7 has the cone-shaped rotating member 120 having a tip of its cone positioned on the outlet port 6 side, and an inner circumference of the product contact avoidance structure 1007 has the thread groove spacer 60 that has the thread groove peak surfaces 61*a*, 62*a*, 63*a*, 64*a* and 65*a* and the thread groove valley surfaces 61*b*, 62*b*, 63*b*, 64*b* and 65*b* that face the outer circumferential surface of the cone-shaped rotating member 120 via predetermined clearances therebetween.

Furthermore, the cone-shaped rotating member 120 according to the modification 7 has a surface of an irregular cross-sectional area, which is perpendicular to the axial direction, and has formed therein a small cross-sectional area portion 121, an outer circumference of which is cut such that the cross-sectional area of a region on the lower side (the outlet port 6 side) of the cone-shaped rotating member 120 becomes smaller than the cross-sectional area on the upper side (the inlet port 4 side).

Note that, in the modification 7, a dimension d6, which is the amount of cutting the cone-shaped rotating member 120, is set at approximately 0.35 mm but is desirably adjusted within a range of 0.1 mm to 0.5 mm in view of all conditions.

Because the turbo molecular pump 1 according to the modification 7 described above has the product contact avoidance structure 1007 that has the cone-shaped rotating member 120 having the small cross-sectional area portion 121, a radial clearance (W7) on the lower side of the cone-shaped rotating member 120 can be enlarged by the amount equivalent to the dimension d6, which is the amount of cutting the cone-shaped rotating member 120 to form the small cross-sectional area portion 121. As a result, the period for the deposited products to come into contact with the cone-shaped rotating member 120 or the thread groove spacer 60 can be extended, the deposited products being likely to deposit in the region where the gas pressure is high.

Moreover, instead of changing the radial clearance (D7) formed on the inlet port 4 side where the cone-shaped rotating member 120 and the thread groove spacer 60 face each other, the radial clearance (W7) on the outlet port 6 side is enlarged. Thus, while preventing significant deterioration of the performance of the turbo molecular pump 1, which is caused by a reflux of the gas as a result of enlarging the clearance on the inlet port 4 side where products rarely deposit, the period for the deposited products to come into contact with the cone-shaped rotating member 120 (the small cross-sectional area portion 121) or the thread groove spacer 60 can be extended, the deposited products being likely to deposit in the region where the gas pressure is high.

Note in the modification 7 that the small cross-sectional area portion 121 is formed in substantially a lower half (½) of the cone-shaped rotating member 120; however the present invention is not limited to this configuration.

For instance, as long as the cross-sectional area on the lower side (the outlet port 6 side) of the cone-shaped rotating member 120 in the axial direction is smaller than the cross-sectional area on the upper side (the inlet port 4 side), the cone-shaped rotating member 120 may have the small cross-sectional area portion 121 formed in the region of ⅓ of the cone-shaped rotating member from the lower side toward the upper side. In other words, the composition ratio in this case is 2 (the upper side):1 (the lower side) in the axial direction of the cone-shaped rotating member 120.

Or, the small cross-sectional area portion 121 can be provided in the region of ¾ of the cone-shaped rotating member from the lower side toward the upper side. In other words, the composition ratio in this case is 1 (the upper side):3 (the lower side) in the axial direction of the cone-shaped rotating member 120.

(Modification 8 of the First Embodiment)

Figure 10:
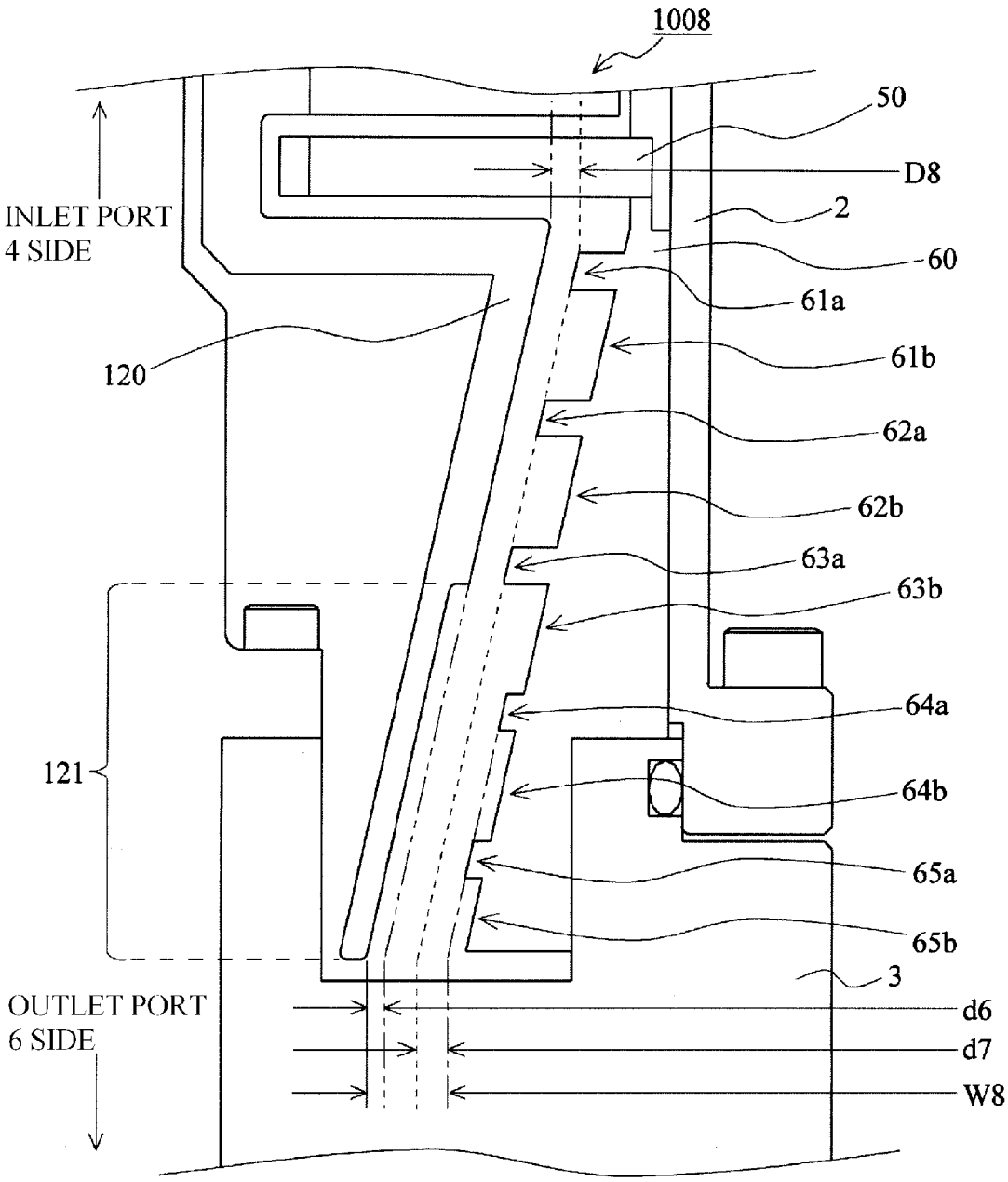
FIG. 10 is a cross-sectional diagram showing an example of a product contact avoidance structure according to a modification 8 of the first embodiment of the present invention.

FIG. 10 is a cross-sectional diagram showing an example of a product contact avoidance structure 1008 according to a modification 8 of the first embodiment of the present invention.

As shown in FIG. 10, the cone-shaped rotating member 120 of the product contact avoidance structure 1008 according to the modification 8 has the small cross-sectional area portion 121 that is same as that of the modification 7.

Of the thread groove peak surfaces 61*a*, 62*a*, 63*a*, 64*a* and 65*a* of the thread groove spacer 60 of the product contact avoidance structure 1008 according to the modification 8, the thread groove peak surfaces 64*a* and 65*a* facing the small cross-sectional area portion 121 of the cone-shaped rotating member 120 are cut such that a radial clearance between these thread groove peak surfaces and the small cross-sectional area 121 gradually becomes larger from the upper side (the inlet port 4 side) toward the lower side (the outlet port 6 side). The amount d7 of cutting the thread groove peak surface 65*a* formed the lowermost end is set at, for example, approximately 0.35 mm (but also can be set within a range of 0.1 mm to 0.5 mm in view of all conditions). Note that a difference in level can be provided between the thread groove peak surface 64*a* and the thread groove peak surface 65*a* by setting the amount of cutting the thread groove peak surface 64*a* at a value smaller than the amount d7 of cutting the thread groove peak surface 65*a*.

With the configuration described above, in the product contact avoidance structure 1008 according to the modification 8, a radial clearance D8 is formed between the cone-shaped rotating member 120 and each of the thread groove peak surfaces 61*a*, 62*a* and 63*a* on the inlet port 4 side, whereas a radial clearance W8 is formed between the thread groove peak surface 65*a* on the outlet port 6 side and the small cross-sectional area portion 121 formed in the cone-shaped rotating member 120, as shown in FIG. 10.

In other words, the radial clearance W8 is equivalent the sum of the dimension d6, which is the amount of cutting the cone-shaped rotating member 120 to form the small cross-sectional area portion 121, the radial clearance D8 between the thread groove peak surface 61*a* on the inlet port 4 side (in the uppermost position) and the cone-shaped rotating member 120, and the dimension d7, which is the amount of cutting the thread groove peak surface 65*a* on the outlet port 6 side (in the lowermost position).

Note in the modification 8 that the thread grooves on the lower side of the thread groove spacer 60 are configured by making the amount of cutting each of the thread groove peak surfaces 64*a* and 65*a* increase slightly and gradually from the inlet port 4 side toward the outlet port 6 side; however, the present invention is not limited to this configuration.

For instance, as long as the inner diameter on the lower side (the outlet port 6 side) of the thread groove spacer 60 in the axial direction is longer than the inner diameter on the upper side (the inlet port 4 side), all of the thread groove peak surfaces may be formed in a step-like manner (i.e., the thread groove peak surfaces of the respective thread grooves form steps in the axial direction).

In the turbo molecular pump 1 having the product contact avoidance structure 1008 according to the modification 8 as described above, the radial clearance (W8) on the outlet port 6 side is enlarged, without changing the radial clearance (D8) between the cone-shaped rotating member 120 and the thread groove spacer 60 (the thread groove peak surfaces) on the inlet port 4 side in the region where the tubular rotating member 120 and the thread groove spacer 60 face each other. Thus, while preventing significant deterioration of the performance of the turbo molecular pump 1, which is caused by a reflux of the gas as a result of enlarging the radial clearance (D8) on the inlet port 4 side where products rarely deposit, the period for the deposited products in the region where the gas pressure is high and products are likely to deposit, to come into contact with the cone-shaped rotating member 120 (the small cross-sectional area portion 121) or the thread groove spacer 60, can be extended longer than ever before.

(ii-2) Second Embodiment

Next, a case in which the thread grooves are formed in the rotor blade cylindrical portion is described with reference to FIGS. 11 to 14.

First, a turbo molecular pump in which the thread grooves are formed in the rotary portion is described with reference to FIG. 11.

Figure 11:
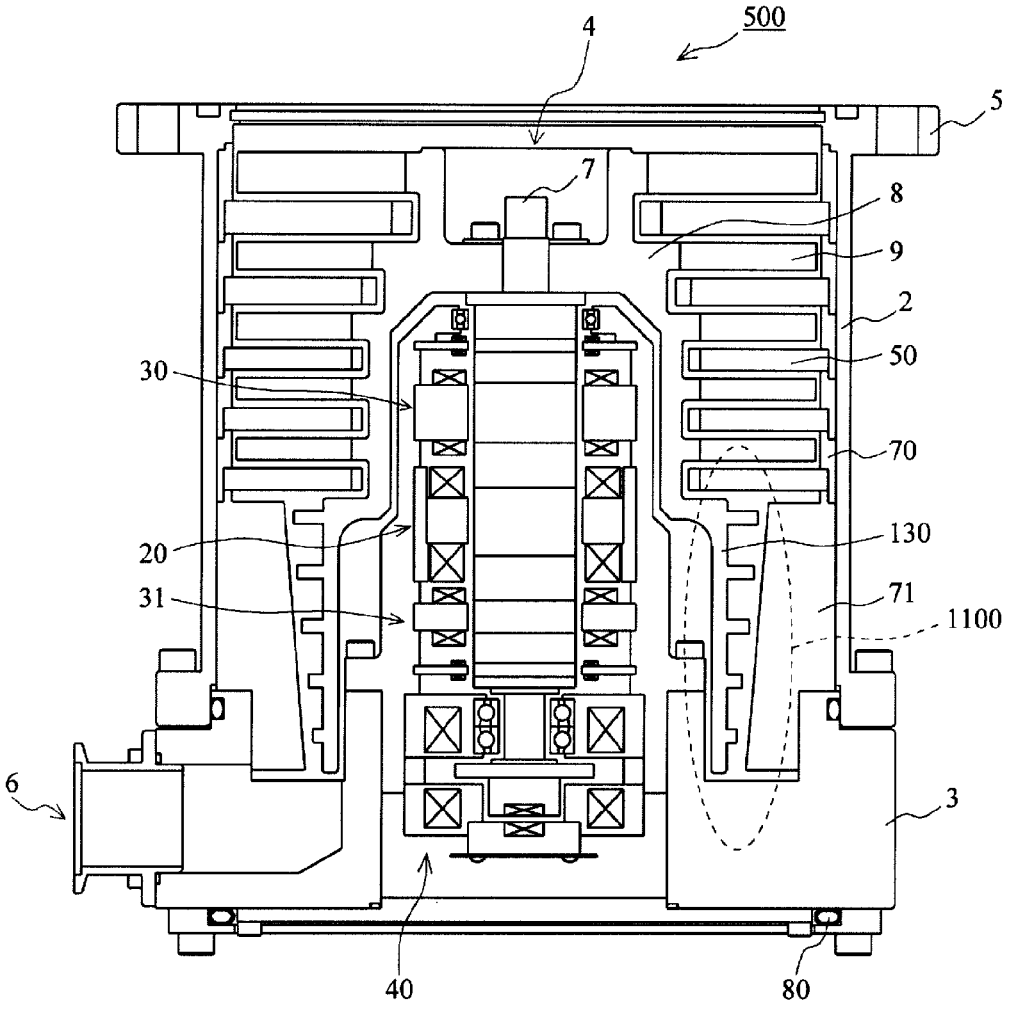
FIG. 11 is a diagram showing a schematic configuration example of a turbo molecular pump having a product contact avoidance structure according to a second embodiment of the present invention.

FIG. 11 is a diagram showing a schematic configuration example of a turbo molecular pump 500 having a product contact avoidance structure 1100 according to a second embodiment of the present invention, the diagram showing a cross-sectional diagram taken along the axial direction of the turbo molecular pump.

Note that the configurations of the turbo molecular pump 500 of the second embodiment of the present invention other than the product contact avoidance structure 1100 are the same as those of the first embodiment. Therefore, the same reference numerals are applied to these same configurations, and the descriptions thereof are omitted accordingly.

In the turbo molecular pump 500 according to the second embodiment of the present invention, a tubular rotating member 130 with spiral grooves is disposed in place of the tubular rotating member 10 of the first embodiment, the tubular rotating member 100, or the cone-shaped rotating member 120.

The direction of the spiral grooves formed in the tubular rotating member 130 with spiral grooves extends toward the outlet port 6, in a case where the gas is transported through the spiral grooves in a direction of the rotation of the rotor 8. The spiral grooves are formed so as to become shallow toward the outlet port 6. Thus, the gas transported through the spiral grooves is sent toward the outlet port 6 while being compressed more toward the outlet port 6. In other words, the spiral grooves function as passages for transporting the gas.

Also, a spacer 71 without the thread grooves is disposed in a spacer (stator portion) that faces the tubular rotating member 130 with spiral grooves, with a predetermined clearance therebetween.

A gas transfer mechanism (a second gas transfer mechanism) for transferring the gas through the thread grooves is configured by causing the spacer 71 and the tubular rotating member 130 with spiral grooves to face each other with a predetermined clearance therebetween, as described above.

In order to lower the force of gas flowing backward toward the inlet port 4 side, the clearance is the smaller the better.

Figure 12:
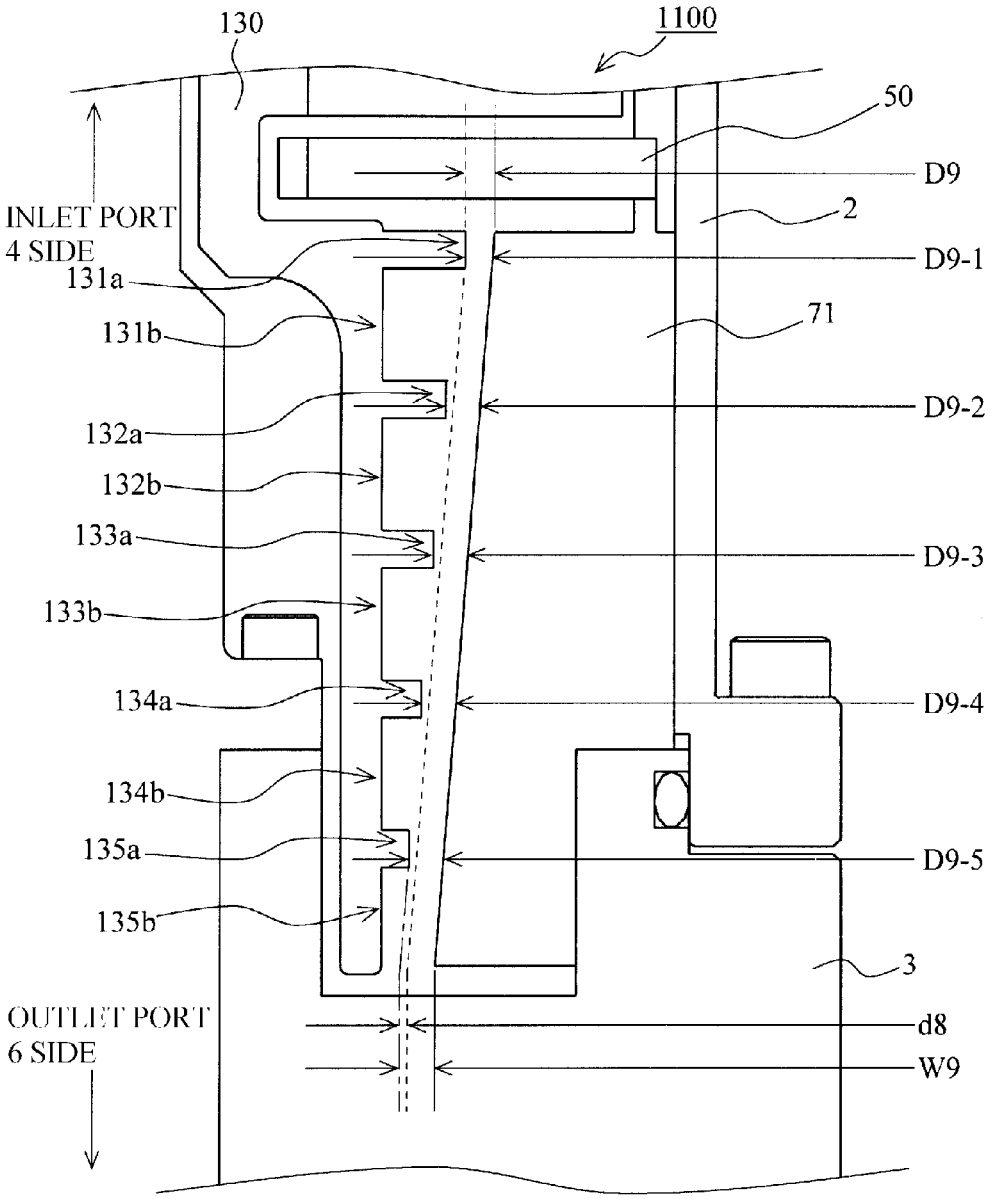
FIG. 12 is a cross-sectional diagram showing an example of the product contact avoidance structure according to the second embodiment of the present invention.

FIG. 12 is a cross-sectional diagram showing an example of the product contact avoidance structure 1100 according to the second embodiment of the present invention.

As shown in FIG. 12, the tubular rotating member 130 with spiral grooves having the product contact avoidance structure 1100 according to the second embodiment of the present invention has spiral grooves that are formed in the form of spirals extending from the inlet port 4 of the turbo molecular pump 500 towards the outlet port 6.

The thread grooves configured respectively by a pair of a thread groove peak surface 131*a* and a thread groove valley surface 131*b*, a pair of a thread groove peak surface 132*a* and a thread groove valley surface 132*b*, a pair of a thread groove peak surface 133*a* and a thread groove valley surface 133*b*, a pair of a thread groove peak surface 134*a* and a thread groove valley surface 134*b*, and a pair of a thread groove peak surface 135*a* and a thread groove valley surface 135*b*, in the tubular rotating member 130 with spiral grooves, are formed to gradually become shallow toward the outlet port 6 side of the turbo molecular pump 500.

In other words, the thread groove formed by the thread groove peak surface 131*a* and the thread groove valley surface 131*b* of the tubular rotating member 130 with spiral grooves is deeper than the thread groove formed by the thread groove peak surface 135*a* and the thread groove valley surface 135*b*.

In a structure where the spiral grooves become shallow may be a structure in which the thread groove valley portions of the tubular rotating member 130 are inclined, in place of a structure where the inner diameter of the spacer 71 is inclined.

In the tubular rotating member 130 with spiral grooves that has the product contact avoidance structure 1100 according to the second embodiment of the present invention, D9-1 is a radial clearance between the thread groove peak surface 131*a* and the spacer 71, and a radial clearance (D9-2) between the thread groove peak surface 132*a* and the spacer 71 is larger than the clearance D9-1. A radial clearance (D9-3) between the thread groove peak surface 133*a* and the spacer 71 is larger than the clearance D9-2. A radial clearance (D9-4) between the thread groove peak surface 134*a* and the spacer 71 is larger than the clearance D9-3. A radial clearance (D9-5) between the thread groove peak surface 135*a* and the spacer 71 is larger than the clearance D9-4. These radial clearances have configurations different from one another.

In other words, the radial clearances between the spacer 71 and the respective thread groove peak surfaces 131*a*, 132*a*, 133*a*, 134*a* and 135*a* of the tubular rotating member 130 with spiral grooves are formed to gradually become larger from the inlet port 4 side of the turbo molecular pump 500 toward the outlet port 6 side. The relationship among the sizes of these clearances is as follows: (D9-1)<(D9-2)<(D9-3)<(D9-4)<(D9-5).

The radial clearance (D9-5) that is formed at the bottom step on the outlet port 6 side in the tubular rotating member 130 with spiral grooves in the product contact avoidance structure 1100 of the second embodiment is larger than the radial clearance (D9-1) formed at the top step on the inlet port 4 side by, for example, approximately 0.35 mm (which can be set within a range of 0.1 mm to 0.5 mm in view of all conditions).

In so doing, in two adjacent thread groove peak surfaces (e.g., the thread groove peak surface 131*a* and the thread groove peak surface 132*a*) among the thread groove peak surfaces 131*a*, 132*a*, 133*a*, 134*a* and 135*a*, the clearances are formed by slightly increasing the amount of cutting the thread groove peak surface (e.g., the thread groove peak surface 132*a*) positioned below (on the outlet port 6 side) the thread groove peak surface (e.g., the thread groove peak surface 131*a*) positioned in an upper step (the inlet port 4 side).

In other words, the amount of cutting the thread groove peak surfaces of the tubular rotating member 130 with spiral grooves according to the second embodiment increases gradually toward the outlet port 6 side.

As a result, thread grooves having step-like cross sections are formed in the tubular rotating member 130 with spiral grooves. The lowermost thread groove peak surface 135*a* is cut more than the uppermost thread groove peak surface 131*a*, and consequently the radial clearance (W9) between the thread groove peak surface 135*a* and the opposing spacer 71 becomes larger than the clearance between the thread groove peak surface 131*a* and the spacer 71 by a dimension d8 (radial length by which the tubular rotating member 130 with spiral grooves is cut).

In the product contact avoidance structure 1100 according to the second embodiment, the outer diameter configured by the thread groove peak surface 135*a* formed on the lower side (the outlet port 6 side) of the tubular rotating member 130 with spiral grooves is smaller (narrower) than the outer diameter configured by the thread groove peak surface 131*a* formed on the upper side (the inlet port 4 side) of the same by a dimension d8×2. Thus, the clearances gradually become larger from the upper side toward the lower side.

According to the turbo molecular pump 500 having the product contact avoidance structure 1100 of the second embodiment, the radial clearances between the thread groove peak surfaces 131*a*, 132*a*, 133*a*, 134*a* and 135*a* of the tubular rotating member 130 with spiral grooves and the spacer 71 gradually become larger from the upper side of the thread groove type pump portion (i.e., the region where products rarely deposit) toward the lower side of the thread groove type pump portion (i.e., the region where the gas pressure is high and products are likely to deposit). This configuration can extend, longer than ever before, the period for the products deposited on the spacer 71 to come into contact with the tubular rotating member 130 with spiral grooves where the vacuum pump is distorted particularly significantly in a direction toward the outlet port 6 due to the thermal expansion or creep phenomenon, or the period for the products deposited on the tubular rotating member 130 with spiral grooves to come into contact with the spacer 71.

Furthermore, instead of changing the radial clearance (D9-1) between the thread groove peak surface (e.g., 131*a*) on the upper of the thread groove type pump portion and the spacer 71, the radial clearance is formed so as to gradually become larger toward the lower side of the thread groove type pump portion. Therefore, the clearance between the thread groove peak surfaces 131*a*, 132*a*, 133*a* and 134*a* and the tubular rotating member 130 becomes larger throughout the whole spacer 71. Thus, significant deterioration of the performance of the turbo molecular pump 500 that is caused by a reflux of the gas from the clearance portions can be prevented.

Note in the second embodiment the thread grooves of the tubular rotating member 130 with spiral grooves are configured by making the amount of cutting each of the thread groove peak surfaces 131*a*, 132*a*, 133*a*, 134*a* and 135*a* of the tubular rotating member 130 with spiral grooves increase slightly and gradually from the inlet port 4 side toward the outlet port 6 side; however, the present invention is not limited to this configuration.

For instance, as long as the outer diameter of the thread groove peak surface on the lower side (the outlet port 6 side) of the tubular rotating member 130 with spiral grooves in the axial direction is shorter than the outer diameter of the thread groove peak surface on the upper side (the inlet port 4 side), the thread groove peak surfaces may be divided into an upper-half group and a lower-half group, to configure two stages of thread groove peak surfaces. Or, the thread groove peak surfaces may be divided into three stages: an upper ⅓ group, a middle ⅓ group, and a lower ⅓ group. In other words, the composition ratio in this case is 1:1:1 in the axial direction of the tubular rotating member 130 with spiral grooves.

The product contact avoidance structure according to the second embodiment of the present invention described above can be modified in various ways as follows.

(Modification 1 of the Second Embodiment)

Figure 13:
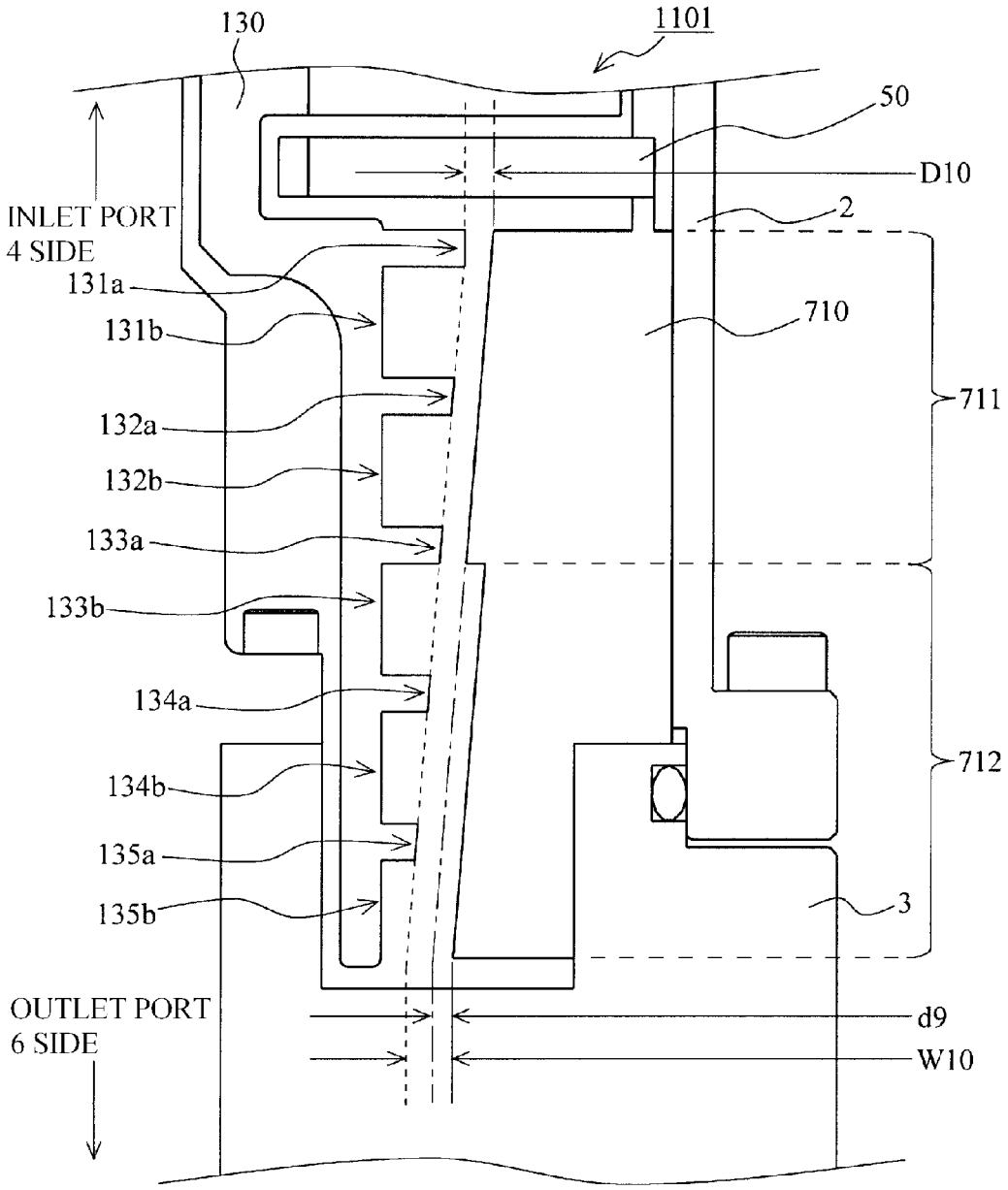
FIG. 13 is a cross-sectional diagram showing an example of a product contact avoidance structure according to a modification 1 of the second embodiment of the present invention.

FIG. 13 is a cross-sectional diagram showing an example of a product contact avoidance structure 1101 according to a modification 1 of the second embodiment of the present invention.

As shown in FIG. 13, the tubular rotating member 130 with spiral grooves having the product contact avoidance structure 1101 according to the modification 1 of the second embodiment of the present invention has spiral grooves that are formed in the form of spirals extending from the inlet port 4 of the turbo molecular pump 500 towards the outlet port 6. In addition, a short inner diameter portion 711 and a long inner diameter portion 712 are formed in a spacer 710.

Of the thread groove peak surfaces 131*a*, 132*a*, 133*a*, 134*a* and 135*a* in the product contact avoidance structure 1101 according to the modification 1 of the second embodiment of the present invention, the thread groove peak surfaces (e.g., the thread groove peak surfaces 131*a*, 132*a* and 133*a*) positioned on the inlet port 4 side face the short inner diameter portion 711 of the spacer 710 with a radial clearance D10 therebetween, while the thread groove peak surfaces (e.g., the thread groove peak surfaces 134*a* and 135*a*) positioned on the outlet port 6 side face the long inner diameter portion 712 of the spacer 710 with a radial clearance W10 therebetween, the radial clearance W10 being larger than the radial clearance D10.

The inner diameter of the spacer 710 according to the modification 1 of the second embodiment of the present invention is not constant in the axial direction, as described above, and the outer diameters thereof on the inlet port 4 side and on the outlet port 6 side are formed to be different from each other such that the radial clearance (W10) on the outlet port 6 side becomes larger than the radial clearance (D10) on the inlet port 4 side.

Specifically, as shown in FIG. 13, the spacer 710 according to the modification 1 of the second embodiment of the present invention has, on the inlet port 4 side (e.g., the upper half of the spacer) where products rarely deposit, the short inner diameter portion 711 that faces the thread groove peak surface 131*a* with the radial clearance D10 therebetween, and, on the outlet port 6 side (e.g., the lower half of the spacer) where the gas pressure is high and products are likely to deposit, the long inner diameter portion 712 that is longer than the short inner diameter portion 711.

According to this configuration of the product contact avoidance structure 1101 according to the modification 1 of the second embodiment of the present invention, the radial clearance (W10) on the outlet port 6 side is formed to be larger than the radial clearance D10 by a length equivalent to a dimension d9, which is a radius difference between the short inner diameter portion 711 and the long diameter portion 712 (the radius difference is d9×2 in terms of diameter).

This dimension d9 is set at approximately 0.35 mm in the present modification, but can also be set within a range of 0.1 mm to 0.5 mm in view of all conditions.

As described above, because the turbo molecular pump 500 according to the modification 1 of the second embodiment of the present invention has the product contact avoidance structure 1101 having the short inner diameter portion 711 and the long inner diameter portion 712 in the spacer 710, only the clearance formed in the section where products are likely to deposit (i.e., the lower side of the spacer 710 where the gas pressure is high) can be enlarged, and the period for the deposited products to come into contact with the tubular rotating member 130 with spiral grooves or the spacer 710 can be extended.

Furthermore, instead of changing the clearance between the spacer 710 (the short inner diameter portion 711) and the thread groove peak surfaces of the tubular rotating member 130 with spiral grooves on the upper side of the spacer 710 (i.e., the region where products rarely deposit), the clearance on the lower side of the spacer 710 (i.e., the region where the gas pressure is high and products are likely to deposit) is partially enlarged. Therefore, the clearance between the tubular rotating member 130 and the thread groove peak surfaces 131*a*, 132*a*, 133*a* and 134*a* is enlarged throughout the whole spacer 710, preventing significant deterioration of the performance of the turbo molecular pump 1, which is caused by a reflux of the gas from the clearance portions.

Note in the modification 1 of the second embodiment of the present invention that the short inner diameter 711 is formed in the upper-half region on the inlet port 4 side of the spacer 710 and the long inner diameter portion 712 in the lower-half region on the outlet port 6 side of the same, to obtain a two-stage configuration; however, the present invention is not limited to this configuration.

For instance, as long as the outer diameter on the lower side (the outlet port 6 side) of the spacer 710 in the axial direction is longer than the inner diameter on the upper side (the inlet port 4 side), the spacer 710 may have a three-stage configuration of three different consecutive inner diameters: a short inner diameter portion in ⅓ of the spacer from the upper side toward the lower side, a long inner diameter portion in ⅓ of the spacer from the lower side toward the upper side, and a middle inner diameter portion in ⅓ of the spacer, between the short inner diameter portion and the long inner diameter portion, the middle outer diameter portion being longer than the short inner diameter portion and shorter than the long inner diameter portion. In other words, the composition ratio among these diameter portions in this case is 1:1:1 in the axial direction of the spacer 710.

Or, the spacer 710 may have a two-stage configuration of consecutive diameters: a short inner diameter portion in ¾ of the spacer from the upper side toward the lower side, and a long inner diameter portion from an end section of the short inner diameter portion toward the lower side (i.e., in ¼ of the spacer from the lower side toward the upper side). In other words, the composition ratio between these diameter portions in this case is 3 (upper side):1 (lower side) in the axial direction of the spacer 710.

(Modification 2 of the Second Embodiment)

Figure 14:
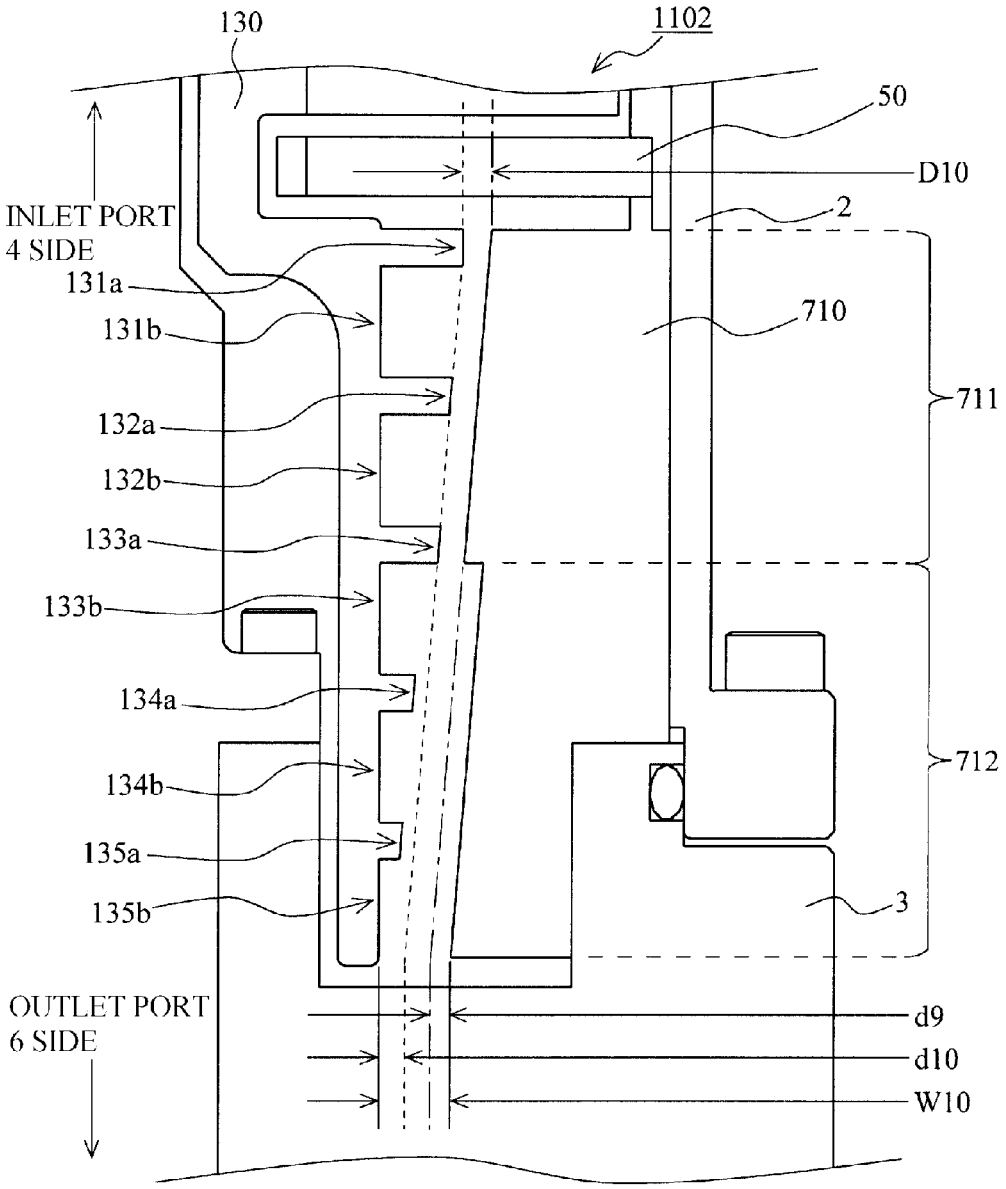
FIG. 14 is a cross-sectional diagram showing an example of a product contact avoidance structure according to a modification 2 of the second embodiment of the present invention.

FIG. 14 is a cross-sectional diagram showing an example of a product contact avoidance structure 1102 according to a modification 2 of the second embodiment of the present invention.

As shown in FIG. 14, the spacer 710 of the product contact avoidance structure 1102 according to the modification 2 of the second embodiment of the present invention has, as with the modification 1 of the second embodiment of the present invention, the short inner diameter portion 711 and the long inner diameter portion 712 that is different from the short inner diameter portion 711 by the radius difference d9. Note that this d9 is set at, for example, approximately 0.35 mm in the modification 2 of the second embodiment of the present invention, but can also be set within a range of 0.1 mm to 0.5 mm in view of all conditions.

Of the thread groove peak surfaces 131*a*, 132*a*, 133*a*, 134*a* and 135*a* of the tubular rotating member 130 with spiral grooves in the product contact avoidance structure 1102 according to the modification 2 of the second embodiment of the present invention, the thread groove peak surfaces 134*a* and 135*a* facing the long inner diameter portion 712 of the spacer 710 are cut such that the radial clearance between the long inner diameter portion 712 and these thread groove peak surfaces gradually become larger from the upper side (the inlet port 4 side) toward the lower side (the outlet port 6 side), and the amount d10 of cutting the thread groove peak surface 135*a* formed at the lowermost end is set at, for example, approximately 0.35 mm (but also can be set within a range of 0.1 mm to 0.5 mm in view of all conditions). Note that a difference in level can be provided between the thread groove peak surface 134*a* and the thread groove peak surface 135*a* by setting the amount of cutting the thread groove peak surface 134*a* at a value smaller than d10 (the amount of cutting the thread groove peak surface 135*a*).

With the structure described above, in the product contact avoidance structure 1102 according to the modification 2 of the second embodiment of the present invention, the radial clearance D10 is formed between the short inner diameter portion 711 and the thread groove peak surfaces 131*a*, 132*a* and 133*a* on the inlet port 4 side, whereas the radial clearance W10 is formed between the thread groove peak surface 135*a* on the outlet port 6 side and the long inner diameter portion 712.

In other words, this radial clearance W10 is equivalent to the sum of d9, which is the difference (in amount of cutting) between the short inner diameter portion 711 and the long inner diameter portion 712, the clearance D10 between the short inner diameter portion 711 and the thread groove peak surface 131*a* on the inlet port 4 side (in the uppermost position), and d10, which is the difference in amount of cutting between the thread groove peak surface 131*a* on the inlet port 4 side and the thread groove peak surface 135*a* on the outlet port 6 side (in the lowermost position).

In the turbo molecular pump 500 having the product contact avoidance structure 1102 according to the modification 2 of the second embodiment of the present invention, the clearance between the spacer 710 and the tubular rotating member 130 with spiral grooves at substantially the upper half of the thread groove type pump portion (i.e., the region where products rarely deposit) is kept constant, and the clearance between the spacer 710 and the tubular rotating member 130 with spiral grooves at substantially the lower half of the thread groove type pump portion (i.e., the region where the gas pressure is high and products are likely to deposit) is formed so as to gradually become larger. For this reason, a sufficient clearance can be secured in the region where the gas pressure is high and deposits are likely to accumulate.

This configuration can extend, longer than ever before, the period for the products deposited on the lower side of the thread groove type pump portion to come into contact with the tubular rotating member 130 with spiral grooves where the vacuum pump is distorted particularly significantly in the direction toward the outlet port 6 due to the thermal expansion or creep phenomenon, or the period for the products deposited on the tubular rotating member 130 with spiral grooves to come into contact with the spacer 710.

In addition, because the clearance between the spacer 710 and the tubular rotating member 130 with spiral grooves in substantially the upper half of the thread groove type pump portion is not changed, significant deterioration of the performance of the turbo molecular pump 500 can be prevented, while extending the period for the tubular rotating member 130 with spiral grooves and the deposited products to come into contact with each other.

Note in the modification 2 of the second embodiment of the present invention that the thread grooves on the lower side of the tubular rotating member 130 with spiral grooves are configured by making the amount of cutting each of the thread groove peak surfaces 134*a* and 135*a* increase slightly and gradually from the inlet port 4 side toward the outlet port 6 side; however, the present invention is not limited to this configuration.

For instance, as long as the outer diameter on the lower side (the outlet port 6 side) of the tubular rotating member 130 with spiral grooves in the axial direction is shorter than the outer diameter on the upper side (the inlet port 4 side), all of the thread groove peak surfaces may be formed in a step-like manner (i.e., the thread groove peak surfaces of the respective thread grooves form steps in the axial direction).

In the first and second embodiments of the present invention, the amount of cutting each of the thread groove peak surfaces (the radial clearances d1 to d10) is set at 0.35 mm in order to enlarge the clearance between the spacer (e.g., the thread groove spacer 60 and the spacer 71) and the rotating member (e.g., the tubular rotating member 10, the tubular rotating member 100, the cone-shaped rotating member 120, the tubular rotating member 130 with spiral grooves) on the outlet port 6 side more than on the inlet port 4 side, in consideration of the suction performance and the exhaust performance of the turbo molecular pump that is approximately 100 to 300 mm in diameter, as well as an overhaul period for removing deposited products. However the amount of cutting is not limited thereto.

Because the optimal value (the range of optimal values) of each clearance varies depending on the type of vacuum apparatus disposed in the vacuum pump, it is desired that the amount of cutting be determined in consideration of the amount of gas, the region of pressure required in the processes performed by the vacuum apparatus, and the like.

The present invention described above can provide a vacuum pump in which the period for deposited products to come into contact with the rotor blade cylindrical portion or the stator portion is extended by changing only the diameter size of a lower portion of the thread groove portion in the rotary portion or stator portion having the thread grooves, to accordingly lengthen an interval for executing an overhaul.

EXPLANATION OF REFERENCE NUMERALS

1 Turbo molecular pump
2 Casing
3 Base
4 Inlet port
5 Flange portion
6 Outlet port
7 Shaft
8 Rotor
9 Rotor blades
10 Tubular rotating member
20 Motor portion
30, 31 Radial magnetic bearing devices
40 Axial magnetic bearing device
50 Stator blades
60 Thread groove spacer
61*a*, 62*a*, 63*a*, 64*a*, 65*a* Thread groove peak surfaces
61*b*, 62*b*, 63*b*, 64*b*, 65*b* Thread groove valley surfaces
70 Spacer
71 Spacer
80 Water jacketed pipe
100 Tubular rotating member
101 Long outer diameter portion (tubular rotating member)
102 Short outer diameter portion (tubular rotating member)
110 Tubular rotating member
113 Tapering outer diameter portion (tubular rotating member)
120 Cone-shaped rotating member
121 Small cross-sectional area portion (cone-shaped rotating member)
130 Tubular rotating member with spiral grooves
131*a*, 132*a*, 133*a*, 134*a*, 135*a* Thread groove peak surfaces
131*b*, 132*b*, 133*b*, 134*b*, 135*b* Thread groove valley surfaces
500 Turbo molecular pump
710 Spacer
711 Short inner diameter portion (spacer)
712 Long inner diameter portion (spacer)
1000 Product contact avoidance structure
1001 Product contact avoidance structure
1002 Product contact avoidance structure
1003 Product contact avoidance structure

1004 Product contact avoidance structure
1005 Product contact avoidance structure
1006 Product contact avoidance structure
1007 Product contact avoidance structure
1008 Product contact avoidance structure
1100 Product contact avoidance structure
1101 Product contact avoidance structure
1102 Product contact avoidance structure Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A vacuum pump comprising:

a casing in which an inlet port and an outlet port are formed;

a stator portion disposed on an inner side surface of the casing;

a rotating shaft enclosed in the casing and supported rotatably;

a rotor portion fixed to the rotating shaft;

a first gas transfer mechanism that has rotor blades disposed radially from an outer circumferential surface of the rotor portion, and stator blades protruding from an inner side surface of the stator portion toward the rotating shaft, and transfers, to the outlet port, gas suctioned from the inlet port by an interaction between the rotor blades and the stator blades; and a second gas transfer mechanism that is disposed on the outlet port side of the first gas transfer mechanism, has a thread groove on either one of opposing surfaces of the rotor portion and the stator portion, transfers, to the outlet port, the gas suctioned from the inlet port, and forms a clearance between thread groove convex surfaces formed in the thread groove and an opposing surface facing the thread groove convex surfaces, wherein the second gas transfer mechanism has a product contact avoidance structure in which a portion of the clearance is larger than a clearance between the thread groove convex surfaces formed on the inlet port side of the thread groove and the opposing surface facing the thread groove convex surfaces during rotation of the rotor portion, the clearance in the region where products accumulate is formed wider.

2. The vacuum pump according to claim 1, wherein the product contact avoidance structure has a structure in which each of the thread groove convex surfaces is cut by gradually increasing the amount of cutting each of the thread groove convex surfaces, from the thread groove convex surface formed on the inlet port side to the thread groove convex surface formed on the outlet port side.

3. The vacuum pump according to claim 2, wherein, in the second gas transfer mechanism, the product contact avoidance structure has a structure in which each of the thread groove convex surfaces, which are formed in a region of ½ of the second gas transfer mechanism in an axial direction, is cut from the outlet port side toward the inlet port side.

4. The vacuum pump according to claim 3, wherein the product contact avoidance structure has a structure in which the opposing surface facing the thread groove is cut by gradually increasing the amount of cutting the opposing surface, from the inlet port side toward the outlet port side.

5. The vacuum pump according to claim 4, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

6. The vacuum pump according to claim 3, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

7. The vacuum pump according to claim 2, wherein the product contact avoidance structure has a structure in which the opposing surface facing the thread groove is cut by gradually increasing the amount of cutting the opposing surface, from the inlet port side toward the outlet port side.

8. The vacuum pump according to claim 7, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

9. The vacuum pump according to claim 2, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

10. The vacuum pump according to claim 1, wherein, in the second gas transfer mechanism, the product contact avoidance structure has a structure in which each of the thread groove convex surfaces, which are formed in a region of ½ of the second gas transfer mechanism in an axial direction, is cut from the outlet port side toward the inlet port side.

11. The vacuum pump according to claim 10, wherein the product contact avoidance structure has a structure in which the opposing surface facing the thread groove is cut by gradually increasing the amount of cutting the opposing surface, from the inlet port side toward the outlet port side.

12. The vacuum pump according to claim 11, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

13. The vacuum pump according to claim 10, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

14. The vacuum pump according to claim 1, wherein the product contact avoidance structure has a structure in which the opposing surface facing the thread groove is cut by gradually increasing the amount of cutting the opposing surface, from the inlet port side toward the outlet port side.

15. The vacuum pump according to claim 14, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

16. The vacuum pump according to claim 1, wherein, in the second gas transfer mechanism, the product contact avoidance structure has a structure in which the opposing surface, facing the thread groove formed in a region of ½ of the second gas transfer mechanism in the axial direction, is cut from the outlet port side toward the inlet port side.

* * * * *